US007726794B2

(12) United States Patent
Shimizu et al.

(10) Patent No.: US 7,726,794 B2
(45) Date of Patent: Jun. 1, 2010

(54) INKJET PRINTER

(75) Inventors: Yoichiro Shimizu, Kasugai (JP); Naoya Okazaki, Gifu-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 762 days.

(21) Appl. No.: 11/712,779

(22) Filed: Feb. 27, 2007

(65) Prior Publication Data

US 2007/0216738 A1 Sep. 20, 2007

(30) Foreign Application Priority Data

Mar. 15, 2006 (JP) ..... 2006-070267

(51) Int. Cl.
*B41J 2/175* (2006.01)

(52) U.S. Cl. ..... 347/87

(58) Field of Classification Search ..... 347/85–87
See application file for complete search history.

(56) References Cited

U.S. PATENT DOCUMENTS

| | | | | |
|---|---|---|---|---|
| 6,010,210 | A * | 1/2000 | Wilson et al. | 347/85 |
| 6,702,427 | B2 * | 3/2004 | Shimizu et al. | 347/50 |
| 7,404,630 | B2 * | 7/2008 | Shimizu | 347/87 |
| 2005/0206691 | A1 | 9/2005 | Takata et al. | |

FOREIGN PATENT DOCUMENTS

JP 2005-262723 9/2005

* cited by examiner

*Primary Examiner*—An H Do
(74) *Attorney, Agent, or Firm*—Frommer Lawrence & Haug LLP

(57) ABSTRACT

An inkjet printer includes a recording head having nozzles to discharge ink and a storage chamber for storing the ink which is supplied to the nozzles from an ink source. The chamber includes an inlet to which the ink flows from the ink source and an outlet from which the ink flows out to the nozzles, two walls opposite to each other and parallel to a flow direction of the ink flowing to the outlet from the inlet, and an annular rim formed along edges of the two walls. The chamber includes a pair of ribs for adjusting an ink flow, which are provided in one of the walls, protrude from the one towards the other, and extend parallel to the flow direction apart from the other. The other wall has flexibility and the ribs are spaced from the rim inside the rim.

16 Claims, 14 Drawing Sheets

INKJET PRINTER

CROSS-REFERENCE OF RELATED APPLICATION

This non-provisional application claims priority under 35 U.S.C. §119(a) on Patent Application No. 2006-070267 in Japan on Mar. 15, 2006, the entire contents of which are hereby incorporated by reference

BACKGROUND

The present invention relates to an inkjet printer.

Conventionally, as an inkjet printer, a type that contains: a recording head having a plurality of nozzle groups to discharge ink drops; and a plurality of ink storage chambers to transiently store inks to be supplied to the nozzle groups from an ink supplying source for each kind, and in order that the pressure variation in the ink is absorbed in the ink storage chamber, one of top and bottom wall surfaces of the ink storage chamber is made of flexible film (for example, refer to Japanese Patent Application Laid-Open No. 2005-262723).

The flexible film requires an area larger than a certain size, in order to absorb the pressure variation in the ink. When such a large area is tried to be reserved, a cross-sectional area of the ink storage chamber in the plan view becomes larger, this bringing about a portion where stagnation is generated in the ink flow.

So, in the configuration described in the Japanese Patent Application Laid-Open No. 2005-262723, it is considered to arrange two flow adjustment ribs which are lower in depth than the ink storage chamber so that the ink smoothly flows to an ink outlet from an ink inlet of the ink storage chamber. The foregoing arrangement of the flow adjustment ribs results in appearance of spaces outside the flow adjustment rib.

BRIEF SUMMARY

There is no ink flow in the spaces outside the foregoing two flow adjustment ribs. Thus, there is a case that, when an ink cartridge is erroneously attached by a user or when it is shipped, the ink flows back from the nozzle of the recording head, and it is mixed with the other color ink inside the ink storage chamber. In such case, the ink in the spaces (stagnation portions) located outside the flow adjustment rib cannot be discharged by a purging operation. Hence, at a recording operation, a problem of the mixture of the color inks arises, which may cause drop in recording quality.

Therefore, it is an object to provide an inkjet printer where the smooth flow of an ink is reserved in an ink storage chamber and the discharge property of the mixture of the color inks is made higher.

There is provided an inkjet printer according to an aspect, comprising: a recording head having a plurality of nozzles to discharge an ink; and a storage chamber for transiently storing said ink which is supplied to said plurality of nozzles from an ink source, wherein said storage chamber includes: an inlet to which said ink flows from said ink source and an outlet from which said ink flows out to said nozzles; two walls opposite to each other and substantially parallel to a flow direction of said ink flowing to said outlet from said inlet; an annular rim formed along edges of the two walls; and a pair of ribs for adjusting an ink flow, which are provided in one wall of said two walls, protrude from the one wall towards the other wall, and extend substantially parallel to said flow direction apart from the other wall, wherein said other wall has a flexibility with respect to a pressure variation generated in said ink, and said pair of ribs are spaced from said rim inside said rim.

When the above-mentioned configuration is employed, for the flexible wall as one wall of the ink storage chamber, while the area enough to absorb the pressure variation in the ink is reserved, the ink flow associated with the ink discharge for the usual recording can be stably generated between the pair of flow adjustment ribs. Even if the air is outside the pair of flow adjustment ribs, the air can be suppressed from being pulled out to the ink outlet under such ink flow. In the ink flow at such as purging operation which is faster than that at the usual recording, the flow can also be stably generated between the pair of flow adjustment ribs, while the air in the ink can be quickly discharged under such flow. Moreover, both ends of the flow adjustment rib in the flow direction are spaced from the inner wall surface of a circumferential wall (the rim). The space links spaces between the pair of flow adjustment ribs and the circumferential wall outside the ribs with a space between the pair of ribs. Thus, even if the mixture of the color inks is between the pair of flow adjustment ribs and the circumferential wall outside them and the stagnation state is consequently generated, the mixture of the color inks can be quickly removed by the fast ink flow at the purging operation or the like.

The above and further objects and features will more fully be apparent from the following detailed description with accompanying drawings.

DETAILED DESCRIPTION

An embodiment will be described below along the drawings.

Figure 1:
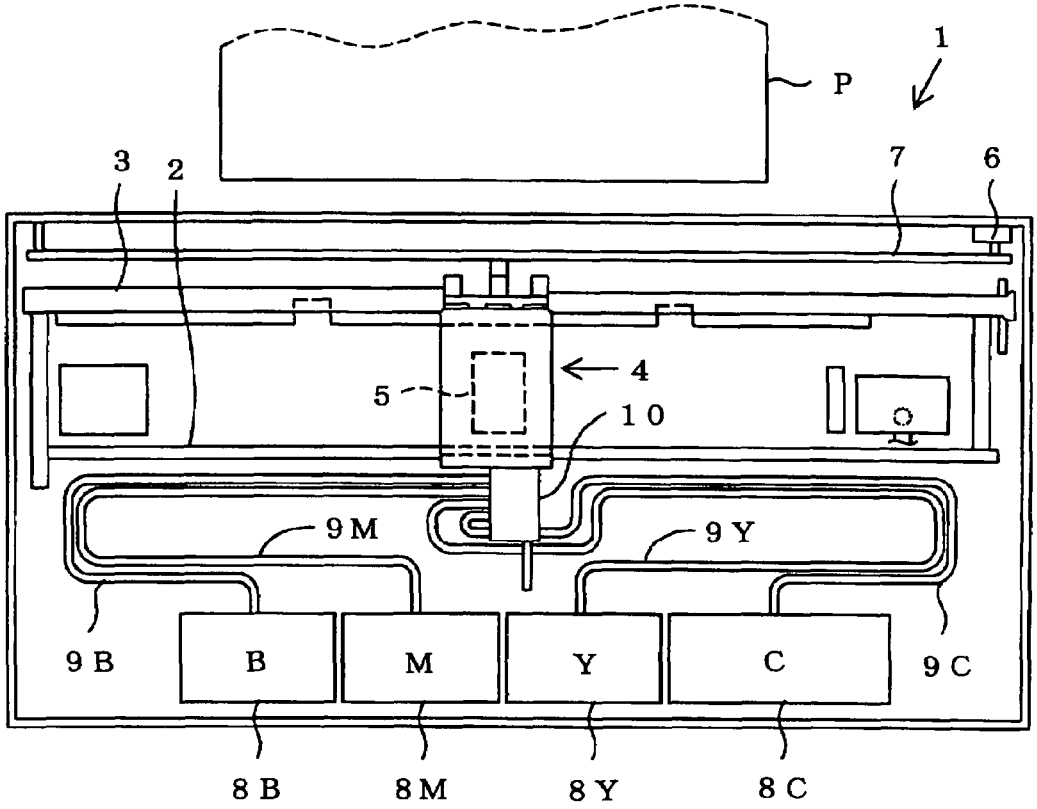
FIG. 1 is an explanation view flatly showing a main configuration of an inkjet printer according to an embodiment.

FIG. 1 is an explanation view flatly showing a main configuration of an inkjet printer according to the embodiment. It is noted that in the following explanation, the left end side on the drawing is referred to as a left direction, the right end side is referred to as a right direction, the bottom side on the drawing is referred to as a front, and the top side on the drawing is referred to as a rear. Also, the side from which ink is discharged is referred to as a bottom surface and a downward direction, and the side opposite thereto is referred to as a top surface and an upward direction.

As shown in FIG. 1, inside an inkjet printer 1, two guide shafts 2, 3 are placed parallel to each other in front and behind, and a head holder 4 doubly acting as a carriage is attached to the guide shafts 2, 3. A recording head 5 for discharging ink liquid drops from nozzle groups and recording on a recording paper P is held in the head holder 4. The head holder 4 is linked to an endless belt 7 which is rotated and driven by a motor 6, and is designed to be reciprocally moved along the guide shafts 2, 3.

Also, a plurality of ink tanks that accommodate the inks for each kind are placed at the central positions in left and right directions of a main body of the inkjet printer 1. In short, an ink tank 8B in which black ink is accommodated, an ink tank 8M in which magenta ink is accommodated, an ink tank 8Y in which yellow ink is accommodated, and an ink tank 8C in which cyan ink is accommodated are placed. The respective ink tanks 8B to 8C are connected through flexible ink supply tubes 9B, 9M, 9Y and 9C to a tube joint 10 on the head holder 4, respectively, and act as the ink supplying sources for supplying the inks to ink storage chambers 41 to 44 which will be described later.

(Main Structure of Head Holder)

The main structure of the head holder 4 will be explained below. The subscripts M, C, B and Y indicate the symbols with regard to the magenta ink, the cyan ink, the black ink and the yellow ink, respectively.

Figure 2:
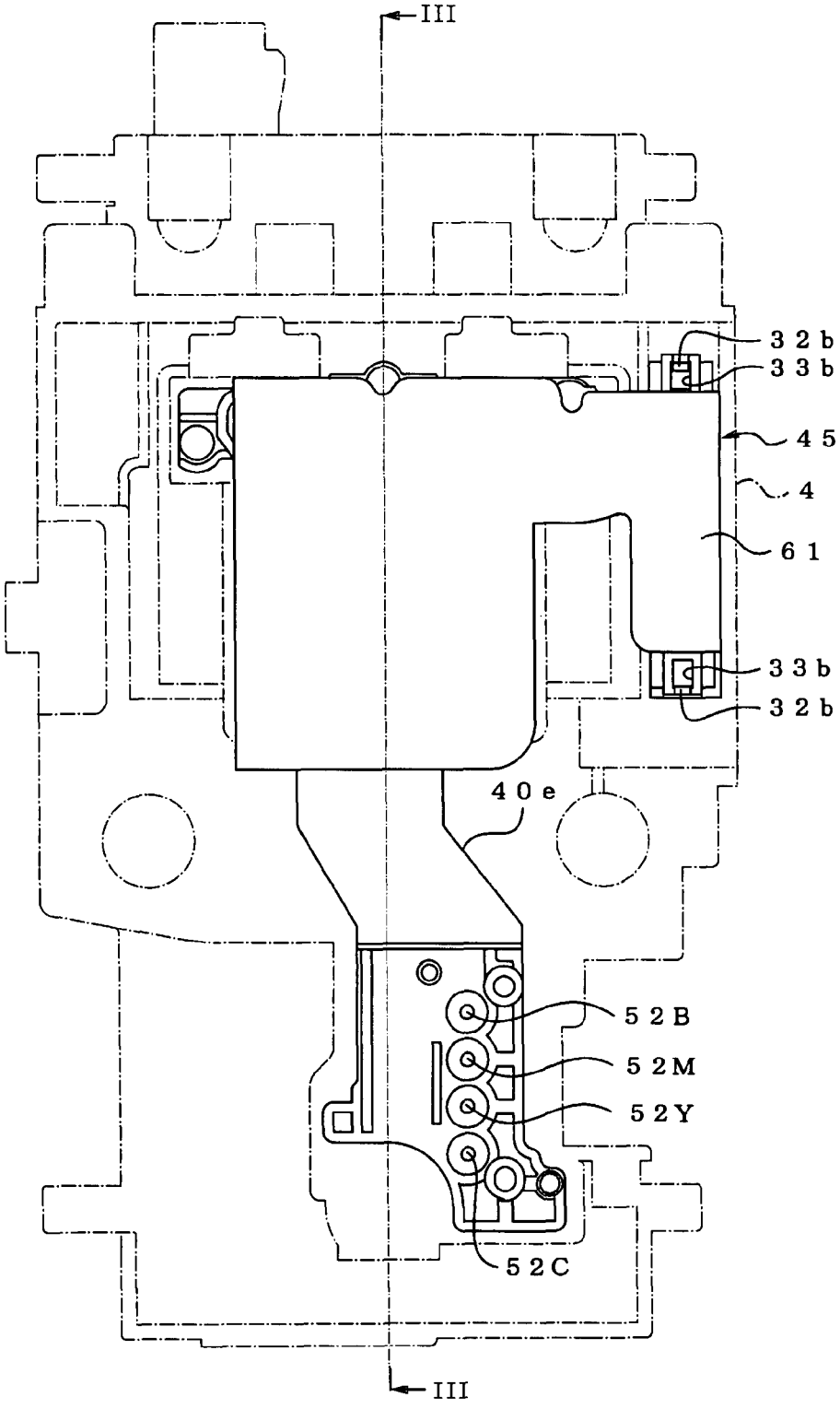
FIG. 2 is a plan view of a head holder in which a buffer tank is installed.
Figure 3:
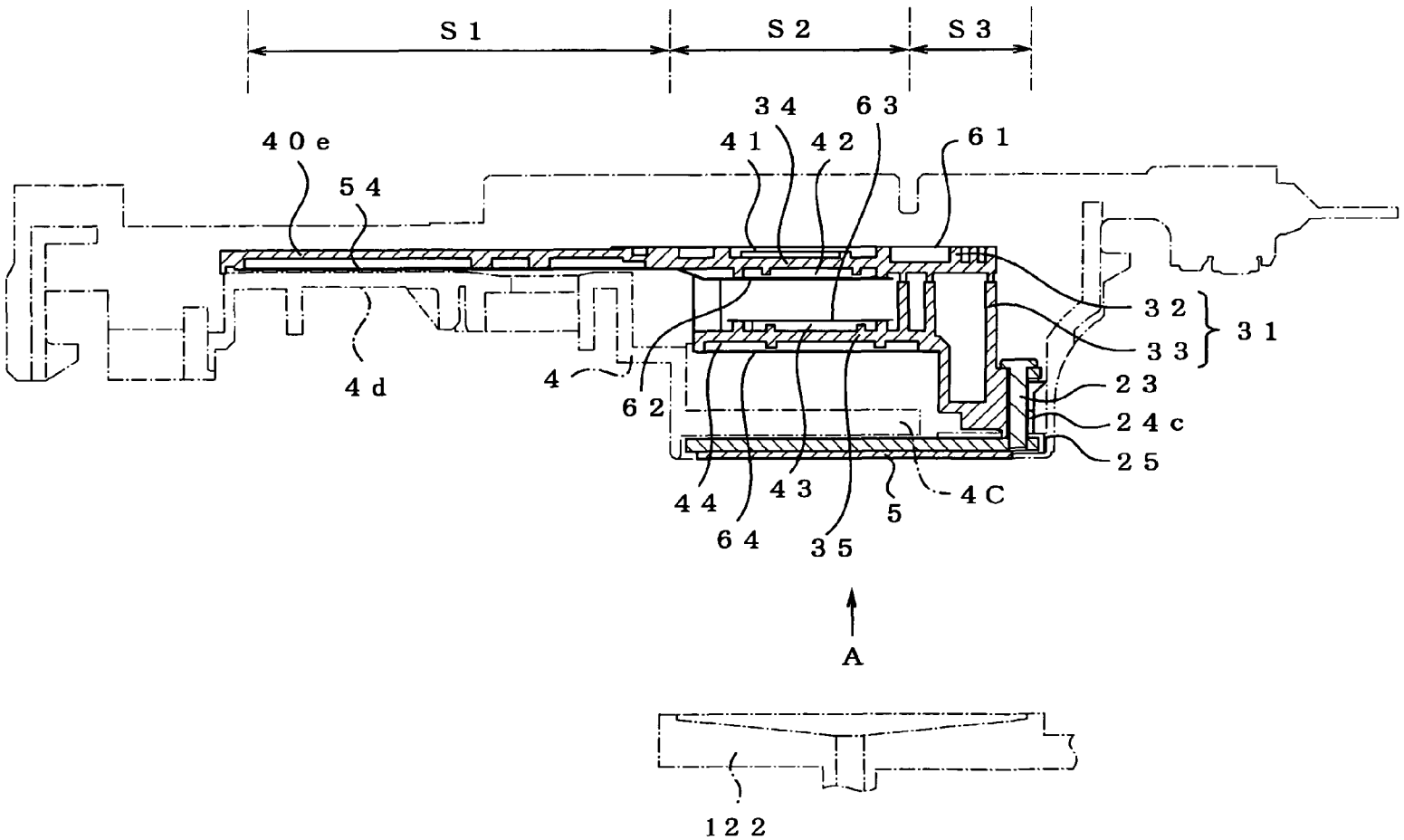
FIG. 3 is a sectional view on a m-m line of FIG. 2.

As shown in FIG. 2 and FIG. 3, the head holder 4 is formed in the shape of a box so that its top surface is opened and a buffer tank 31 is accommodated and the recording head 5 is held on the bottom surface of its bottom wall 4*c*.

Figure 4:
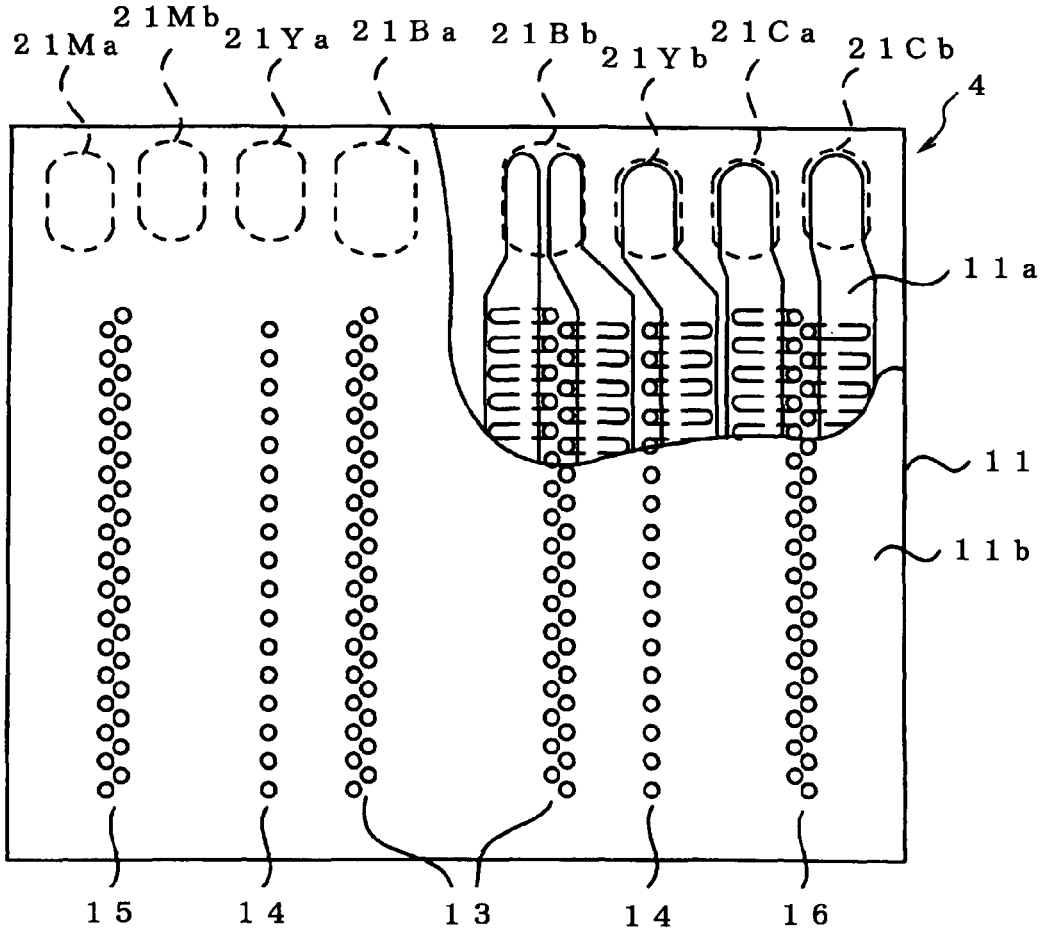
FIG. 4 is an explanation view of a recording head when it is viewed from an A-direction of FIG. 3.
Figure 5:
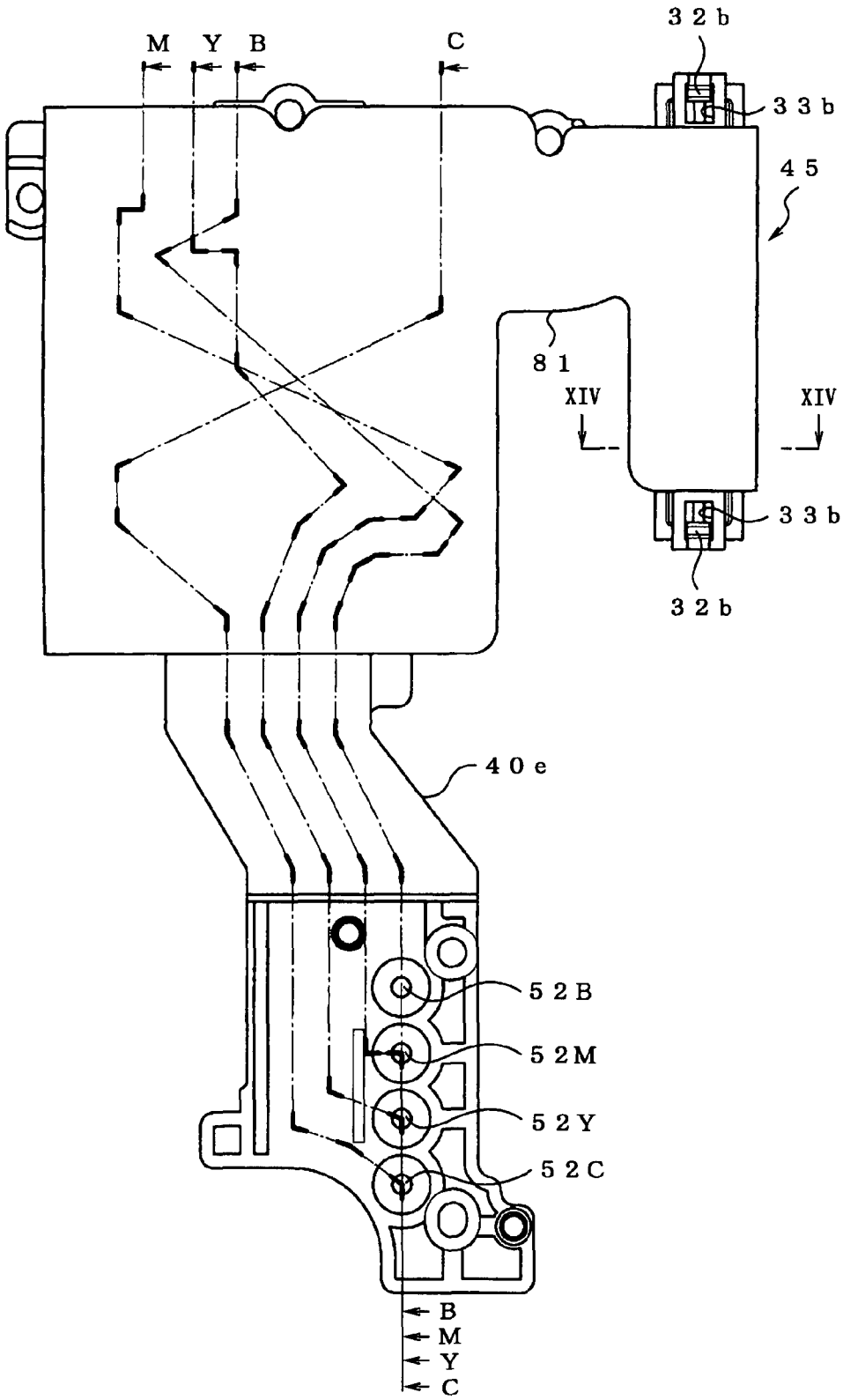
FIG. 5 is a plan view when the buffer tank is viewed from a top side.

The recording head 5 is configured such that as shown in FIG. 4, a cavity unit 11 having nozzles 13 to 16, each of which is aligned for each ink color, and a piezoelectric actuator (not shown) for generating a pressure to selectively discharge the inks from the nozzles are laminated. The cavity unit 11 has two ink flow inlets 21Ma and 21Mb, 21Ya and 21Yb, 21Ba and 21Bb, and 21Ca and 21C, for each ink color, on the top surface. The ink flow inlets 21Ma and 21Mb, 21Ba and 21Bb, and 21Ca and 21Cb of the magenta ink, the black ink and the cyan ink, respectively, are arranged in two rows for each ink. However, the two rows of the ink flow inlets 21Ya, 21Yb of the yellow ink are arranged apart from each other with the ink flow inlets 21Ba, 21Bb interposed between them.

It is noted that in the respective ink flow inlets 21M to 21C, their top surfaces are covered with ink filtering filters (not shown), and the inks are supplied through respective ink flow paths 11*a* inside the cavity unit 11 to the nozzles 13 to 16 in the respective rows.

(Main Configuration of Buffer Tank 31)

The buffer tank 31 is accommodated in the head holder 4. The buffer tank 31 is configured such that as shown in FIG. 3, in the upward/downward direction, a top tank 32 and a bottom tank 33 are linked parallel to each other, and in the forward/backward direction, an ink input area S1, a buffer area S2 and an ink output area S3 are defined in an order starting from the front side.

In the buffer area S2, in the top tank 32, the ink storage chamber 41 for storing the yellow ink is formed on the top side, and the ink storage chamber 42 for storing the magenta ink is formed on the bottom side, respectively, and they are adjacent to each other, with the middle wall 34 between. In the bottom tank 33, the ink storage chamber 43 for storing the cyan ink is formed on the top side, and the ink storage chamber 44 for storing the black ink is formed on the bottom side, respectively, and they are adjacent to each other, with the middle wall 35 between. Those ink storage chambers 41 to 44 are arranged parallel to each other and in the lamination state in the upward/downward direction, and they are divided such that the two ink storage chambers are formed in the top and bottom tanks 32, 33, respectively. In short, the ink storage chambers 41 to 44 are arranged parallel to each other. Then, the ink storage chambers 41 to 44 are also arranged parallel to the recording head 5.

Consequently, in the buffer tank 31, the ink storage chambers 41 to 44 are arranged in the lamination state, in the order starting from the top side, and the respective yellow, magenta, cyan and black inks are transiently stored for each kind. In short, the ink storage chambers 41 to 44 transiently store the inks to be supplied to the nozzle groups of the recording head from the ink tanks 8B to 8C, for each kind.

In the ink output area S3, ink output paths 51M, 51Ya, 51B, 51Yb and 51C corresponding to the ink storage chambers 41 to 44 are lined up in a scanning direction of the recording head 5 behind the buffer area S2, namely, arranged in the substantial line along the array direction of ink flow inlets 21M to 21C of the recording head 5.

Figure 8:
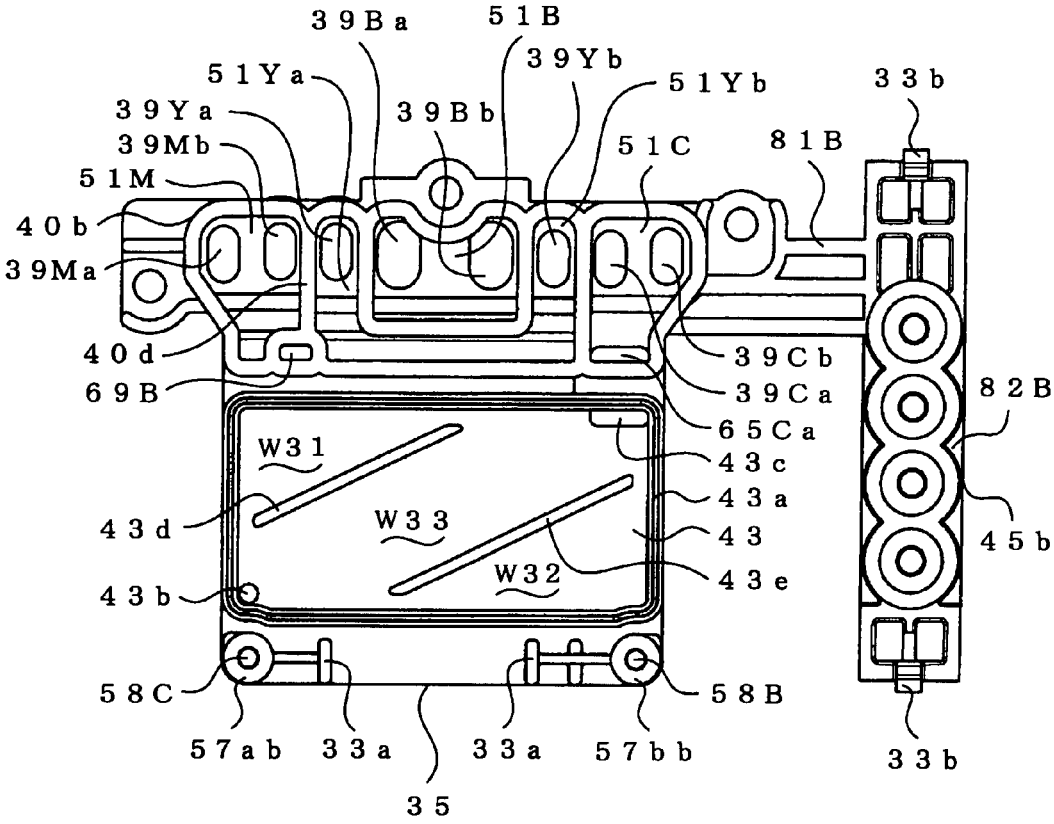
FIG. 8 is a plan view when a bottom tank is viewed from above.

The ink output paths 51M to 51C are extendedly formed in the lamination direction of the ink storage chambers 41 to 44 at the lengths substantially equal to each other. In short, the ink output paths 51M to 51C are formed, as shown in FIG. 8, such that the insides of cylindrical walls 40*a*, 40*b* formed correspondingly to the top and bottom tanks 32, 33, respectively, are divided for each ink by division walls 40*c*, 40*d*. The ink output path 51B at the array direction center of the respective ink output paths 51M to 51C opens two ink supply ports 39Ba, 39Bb opposite to central two ink flow inlets 21Ba, 21Bb of the recording head 5, at the bottom end. The ink output path 51C at the end of one array direction opens two ink supply ports 39Ca, 39Cb opposite to two ink flow inlets 21Ca, 21Cb on the same side as the recording head 5, at the bottom end. The ink output path 51M at the other end in the array direction opens two ink supply ports 39Ma, 39Mb opposite to two ink flow inlets 21Ma, 21Mb on the same side as the recording head 5, at the bottom end.

The ink output path 51Yb sandwiched between one end and the central ink output paths 51C, 51B opens one ink supply port 39Yb opposite to one ink flow inlet 21Yb of the recording head 5. The ink output path 51Ya sandwiched between the other end and the central ink output paths 51M, 51B opens one ink supply port 39Ya opposite to one ink flow inlet 21Ya of the recording head 5. In short, the two ink output paths 51Ya, 51Yb of the yellow ink are arranged apart, with the ink output path 51B interposed between them, correspondingly to the ink flow inlets 21Ya, 21Yb of the recording head 5.

The top ends of the two ink output paths 51Ya, 51Yb are linked through an ink guide path (linkage) 48Y to each other. This ink guide path 48Y is installed such that the ink output path 51B of the black ink is detoured on the sides of the ink storage chambers 41 to 44. An ink outlet 41*c* of the ink storage chamber 41, which will be described later, is opened on the side of the ink output path 51Ya of this ink guide path 48Y. Also, a protrusion rib 49 for suppressing an air flow to the side of the ink output path 51Ya is perpendicularly hung on the side of the ink output path 51Ya on the side close to this ink outlet 41*c*. The bottom end of the protrusion lib 49 is longer than the bottom end of the top tank 32 and defined as the length that enables the invasion into the bottom tank 33, and the gap that allows the distribution of the ink is installed between it and the bottom surface of the ink guide path 48Y formed in the bottom tank 33. In short, the protrusion lib 49 is located with the gap that allows the distribution of the ink in the bottom, although suppressing the air flow to the side of the ink output path 51Ya.

The ink output paths 51M to 51C are extended in the upward/downward direction, respectively. Thus, the airs are excellently separated from the inks that flow into the ink flow inlets 21M to 21C of the recording head 5 from the respective ink storage chambers 41 to 44, which will be described later, and the airs are accumulated in upper spaces of the ink output paths 51M to 51C. In short, the upper spaces of the ink output paths 51M to 51C function as air trap regions where the airs are accumulated after the airs included in the inks are separated.

The airs accumulated in the upper spaces of the ink output paths 51M to 51C as mentioned above are discharged through air discharge ports 46M, 46Ya, 46B, 46Yb and 46C formed in the top ends of the respective ink output paths 51M to 51C to discharge paths 71M to 71B.

The cylindrical walls 40*a*, 40*b* and the division walls 40*c*, 40*d*, which constitute the ink output paths 51M to 51C, are formed such that they are divided into the top and bottom portions, correspondingly to the top and bottom tanks 32, 33, respectively. In short, the cylindrical wall 40*b* and the division wall 40*d* where the ink output paths 51M to 51C are interiorly formed on one sides of the ink storage chambers 41 to 44 are formed in the bottom tank 33. On the other hand, the cylindrical wall 40*a* and the division wall 40*c*, which are the extension portions that overlap with the top ends of the cylindrical wall 40*b* and the division wall 40*d* and constitute the top end portions of the ink output paths 51M to 51C, are installed in the top tank 32. In this cylindrical portion 40*a*, the top ends of the ink output paths 51M to 51C are opened in the discharge paths 71M to 71B as the air discharge ports 46M to 46B to discharge the airs included in the inks.

Since the cylindrical walls 40*a*, 40*b* and the division walls 40*c*, 40*d* in both of the tanks 32, 33 are made coincident and joined in their states by using a joining method, such as a supersonic welding, an adhesion and the like, the top portions and bottom portions of the ink output paths 51M to 51C are joined, and the respective ink output paths 51M to 51C are continuously formed in the entire top and bottom tanks 32, 33. Simultaneously with this, the top and bottom tanks 32, 33 are coupled to each other and made into a single unit. Also, in its state, as mentioned above, the ink storage chambers 41 to 44 are formed as the lamination state.

The ink input area S1 contains an extension 40*e* that extends from the buffer area S2 to its forward direction. The extension 40*e* is piled on and supported by an attachment arm 4*a* that extends from the front end of the head holder 4 in a forward direction and a horizontal direction, as shown in FIG. 3. A tube joint 10 is attached onto the top surface in front of the extension 40*e*. The ink supply tubes 9B to 9C are connected to the tube joint 10, and the respective ink supply tubes 9B to 9C are linked to ink flow path openings 52B to 52C that are opened on the top surface of the extension 40*e*, correspondingly to a one-to-one relation.

Figure 7:
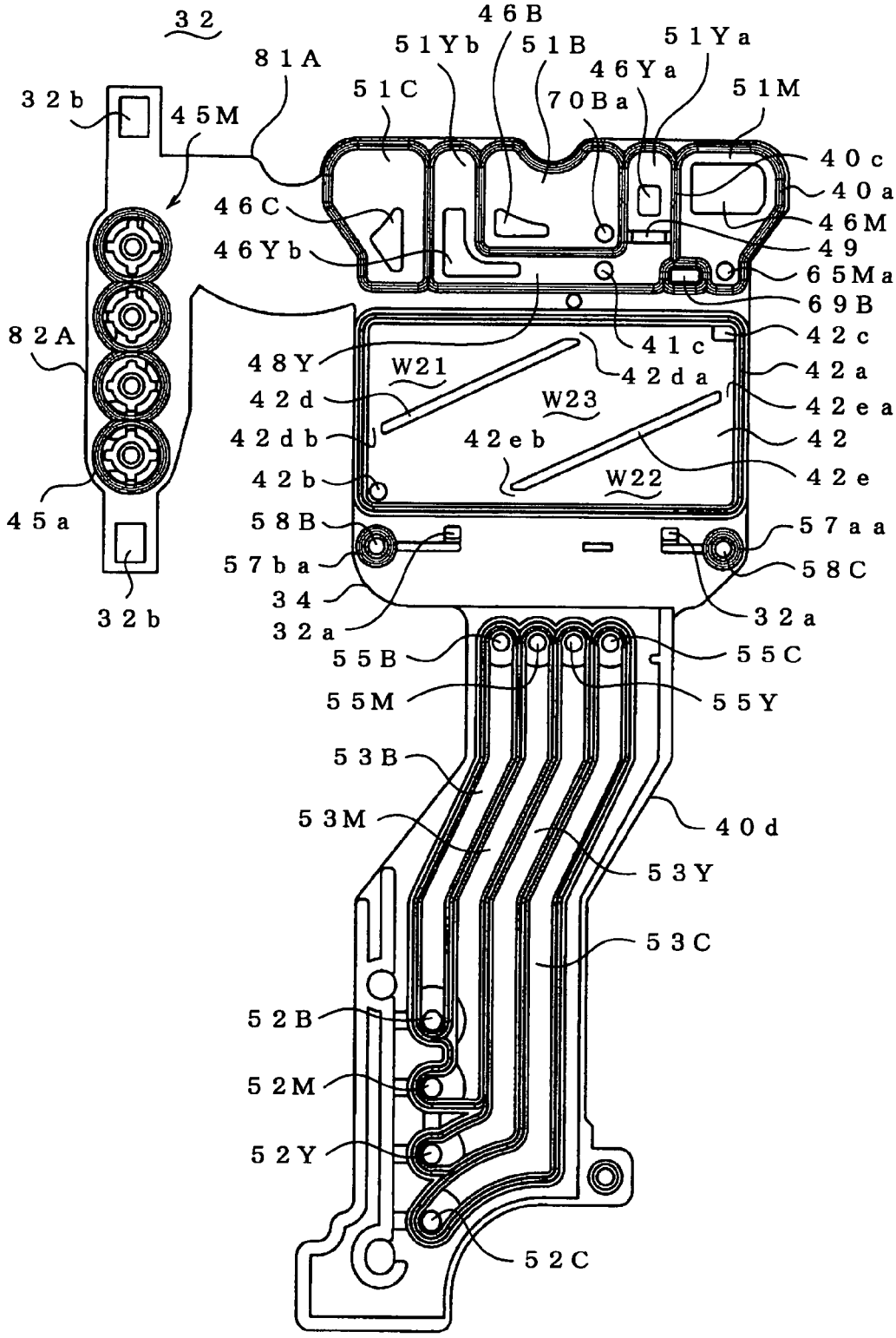
FIG. 7 is a plan view when the top tank is viewed from below.

In the bottom surface of the extension 40*e*, as shown in FIG. 7, ink flow paths 53B, 53M, 53Y and 53C whose upstream ends are connected to the ink flow path openings 52B to 52C, respectively, are formed. The respective ink flow paths 53B to 53C are formed as concave grooves each extending in the forward/backward direction and are abreast arranged in the left/right direction in the bottom surface of the extension 40*e*.

The respective open surfaces in the longitudinal directions on the bottom surfaces of the ink flow paths 53B to 53C are sealed with films 54 (refer to FIG. 3). The films 54 play the roles as the bottom surfaces of the respective ink flow paths 53B to 53C, and the respective ink flow paths 53B to 53C are formed by the inner surfaces (the top surface and the left and right sides) of the concave grooves and the films 54.

Figure 6:
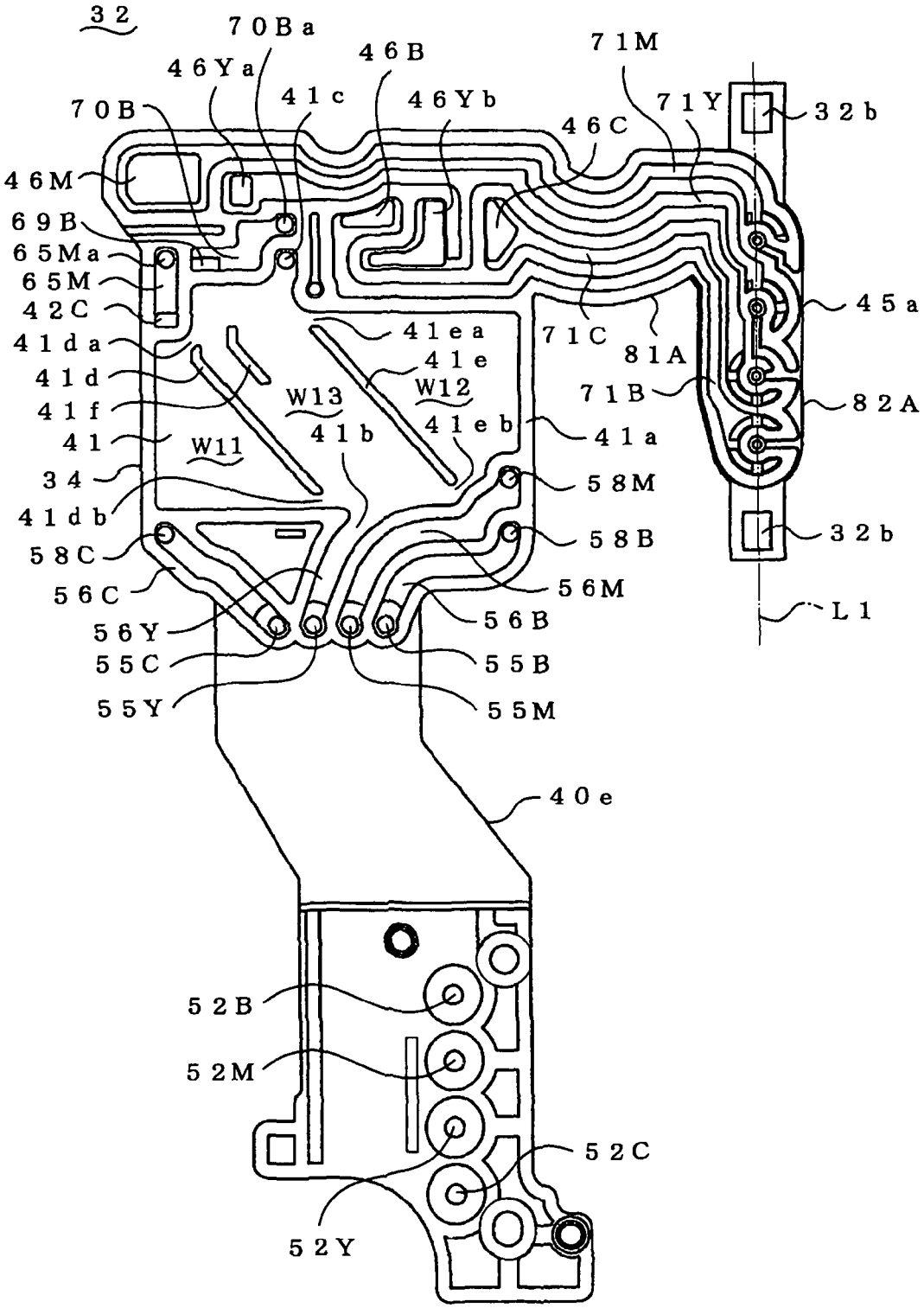
FIG. 6 is a plan view when a top tank is viewed from above.

The extension 40*e* is integrally formed in linkage to the middle wall 34 (refer to FIG. 3) of the top tank 32, and the back ends of the ink flow paths 53B to 53C are connected to ink flow paths 56B, 56M, 56Y and 56C formed in the top surface of the extension 40*e*, through ink input holes 55B, 55M, 55Y, 55C, which penetrate the extension 40*e* upwardly and downwardly, respectively, as shown in FIG. 6.

The ink flow paths 56C, 56B at the left and right ends are connected to the ink storage chambers 44, 43 of the bottom tank 33 through ink linkage paths 58C, 58B, respectively, which will be described later, and the two central ink flow paths 56Y, 56M are connected to the ink storage chambers 41, 42 of the top tank 32, respectively.

Cylindrical walls 57*a*, 57*b* are protrusively formed at the positions where they overlap with the back ends of the ink flow paths 56C, 56B at the left and right ends on the planes opposite to the top and bottom tanks 32, 33 when they are viewed from the flat plane, and the top ends of the ink linkage paths 58C, 58B, which penetrate the cylindrical walls 57*a*, 57*b*, are connected to the back ends of the ink flow paths 56C, 56B. The cylindrical walls 57*a*, 57*b* are arranged apart from each other near both ends in the left/right direction of the ink storage chambers along the front edge sides of the ink storage chambers 41 to 44 and arranged correspondingly to the ink output paths 51M, 51C, which are located at both of the left and right ends of the ink output paths 51M, 51C, in the forward/backward direction.

The cylindrical walls 57*a*, 57*b* are formed such that protrusion portions 57*aa*, 57*ab* on the side of the top tank 32 and protrusion portions 57*ba*, 57*bb* on the side of the bottom tank 33 are joined to each other. Since the protrusion portions 57*aa*, 57*ab*, 57*ba* and 57*bb* of the cylindrical walls 57*a*, 57*b* are joined to each other by using the joining method, such as the supersonic welding, the adhesion and the like, the ink flow paths 56C, 56B of the top tank 32 and the ink storage chambers 43, 44 of the bottom tank 33 are connected through the ink linkage paths 58C, 58B. It is noted that the cylindrical walls 57*a*, 57*b* may be formed so as to protrude from only one of the top tank 32 and the bottom tank 33.

Also, when the protrusion portions 57*aa*, 57*ab*, 57*ba* and 57*bb* of both the cylindrical walls 57*a*, 57*b* are joined to each other, the foregoing cylindrical walls 40*a*, 40*b* are also joined at the same time. Thus, the top and bottom tanks 32, 33 are linked to each other and integrated into the single unit.

It is noted that in the vicinities of the cylindrical walls 57*a*, 57*b*, a fastener 32*a* protrusively formed in the top tank 32 is fastened in contact with a fastened part 33*a* protrusively formed in the bottom tank 33, in a direction where the relative rotation of the top tank 32 to the bottom tank 33 is regulated. Consequently, even if the widths in the left/right direction of the top and bottom tanks 32, 33 are wide, both of them can be stably joined.

(Main Structure of Respective Ink Storage chambers 41 to 44)

The main structures of the respective ink storage chambers 41 to 44 will be described below with reference to the drawings.

—Structure of Ink Storage chamber 41 of Yellow Ink—

The ink storage chamber 41 is explained with reference to FIG. 6 and FIG. 10.

In the buffer area S2, a circumferential wall (rim) 41*a*, which is substantially rectangular in a plan view, is installed on the top surface around the middle wall 34 in the top tank 32, and the upper opening of the inner space surrounded with the circumferential wall 41*a* is enclosed with a film 61 that is deformable and flexible, and the ink storage chamber 41 of the yellow ink that is constituted by flat space is formed. The flexibility of this film 61 implies flexibility with which it can be flexed by the pressure change generated in the ink inside the ink storage chamber 41.

This ink storage chamber 41 is designed such that near the substantial center of the front portion of the circumferential wall 41*a*, the downstream end of the ink flow path 56Y is opened as an ink inlet 41*b*, and the ink from the ink tank 8Y flows therein. Also, at the position which is located slightly close to the left side from the center in the left/right direction of the rear portion of the circumferential wall 41*a* and is displaced to the right direction from the backward left corner of the ink storage chamber 41 and is slightly protruded to the backward direction from the rear portion of the circumferential wall 41*a*, an ink outlet 41*c* from which the yellow ink inside the ink storage chamber 41 flows out is formed, and the ink flows out to the nozzle of the recording head 5.

Then, the ink inlet 41*b* and ink outlet 41*c* of the yellow ink are arranged under the relation that they are located on a substantial diagonal line of the ink storage chamber 41. In other words, they are formed at the positions located substantially farthest from each other, with most of the space inside the ink storage chamber 41 between. Thus, the ink storage chamber 41 contains: a pair of wall surfaces (one wall surface that is the bottom surface of the film 61 and the other wall surface that is the top surface of the middle wall 34) which are parallel and opposite to the flow direction of the ink that is supplied to the ink outlet 41*c* from the ink inlet 41*b*; and the circumferential wall 41*a* which surrounds the periphery of the space between the pair of wall surfaces.

The ink outlet 41*c* downwardly penetrates from the bottom surface of the ink storage chamber 41 to the middle wall 34 of the top tank 32 and is opened above the ink guide path 48Y and then connected through the ink guide path 48Y to the two ink output paths 51Ya, 51Yb and further connected from the respective ink output paths 51Ya, 51Yb to the ink flow inlets 21Ya, 21Yb of the recording head 5. In short, between the two ink output paths 51Ya, 51Yb corresponding to the two ink flow inlets 21Ya, 21Yb of the yellow ink, the ink output path 51B of the black ink is arranged. Correspondingly, they are separately installed. Hence, while the ink output path 51B of the black ink is detoured, the top portions of the ink output paths 51Ya, 51Yb of the yellow ink are linked to each other through the ink guide path 48Y.

It is noted that through the ink guide path 48Y, the top portions of the ink output paths 51Ya, 51Yb of the yellow ink are linked to each other. However, at least the top portions may be linked to each other, and the middle portions linked to the top portions can be also configured to be linked to each other.

The film 61 encloses not only the top opening of the circumferential wall 41*a* but also the portions that are opened above the ink flow paths 56M to 56Y, and a connection output path 65M, an ink path 70B and discharge paths 71M to 71B, which will be described later. In short, the top surfaces of the side walls that define the outer circumferences of the ink flow paths 56M to 56Y, the connection output path 65M, the ink path 70B and the discharge paths 71M to 71B are formed on the same flat surface as the top surface of the circumferential wall 41*a* around the ink storage chamber 41, and the film 61 is joined onto the top surface by using the joining method such as the adhesion, thermal welding and the like. Thus, the ink storage chamber 41, the ink flow paths 56M to 56Y, the connection output path 65M, the ink path 70B and the discharge paths 71M to 71B are respectively zoned.

Also, in the flat bottom wall (the top surface of the middle wall 34) of the ink storage chamber 41, a pair of flow adjustment ribs 41*d*, 41*e*, which are located inside the circumferential wall 41*a* and located under a certain interval on both sides of a line to link the ink inlet 41*b* and ink outlet 41*c* of the yellow ink and then protrude towards the film 61 (one wall) and also extend parallel to the ink flow direction apart from the film 61, are respectively raised up and integrally formed,.

The pair of flow adjustment ribs (ribs) 41*d*, 41*e* guides the fast flow of the ink to the ink outlet 41*c* from the ink inlet 41*b*. In addition, a guide rib (ridge) 41*f* composed of small pieces, each having a bent part, is formed so as to guide the ink flow towards the ink outlet 41*c* along the bent flow adjusting rib 41*d*, near the ink outlet 41*c* and between the flow adjustment rib 41*d* and the flow adjustment rib 41*e*.

In those flow adjustment ribs 41*d*, 41*e* and guide rib (ridge) 41*f*, each longitudinal section is rectangular, and all of them are formed at the heights equal to about half of a depth of the ink storage chamber 41 (the distance from the film 61 to the bottom surface) and separated from the film 61 so that the movement of the film 61 is not limited.

Also, the pair of flow adjustment ribs 41*d*, 41*e* is located apart from the circumferential wall (rim) 41*a* outside the mutual opposite directions of both the flow adjustment ribs 41*d*, 41*e*, by triangular spaces W11, W12 when they are viewed from flat planes. The ends of the ink flow directions of the pair of flow adjustment ribs 41*d*, 41*e* are separated from the inner wall surface of the circumferential wall 41*a* in their extension directions, by intervals 41*da*, 41*db*, 41*ea* and 41*eb*. Thus, through the intervals 41*da*, 41*db*, 41*ea* and 41*eb*, a space W13 (a space serving as the ink flow path) between the pair of flow adjustment ribs 41*d*, 41*e* and the spaces W11, W12 from the circumferential wall 41*a* outside them are connected. It is noted that the intervals 41*da*, 41*db*, 41*ea* and 41*eb* are set at lengths of about 1 to 2 mm, so as not to damage the flow adjustment effects of the flow adjustment ribs 41*d*, 41*e*.

Thus, the ink flow associated with the ink discharge for usual recording is stably generated in the space W13 between the pair of flow adjustment ribs 41*d*, 41*e*, from the ink inlet 41*b* to the ink outlet 41*c*. There is a possibility that the air stays in the external spaces W11, W12. However, at the velocity of this ink flow, the withdrawal of the air can be suppressed by the flow adjustment ribs 41*d*, 41*e*. The intervals 41*da*, 41*ea*, 41*db* and 41*eb* do not damage the ink flow.

Also, when the flow faster than the flow of the ink associated with the ink discharge for the usual recording is generated by the purging operation for bringing a first cap member 122 (refer to FIG. 3), which will be described later, into contact with the nozzle surface of the recording head 5 and consequently sucking the residual ink through a sucking pump, the stable flow can be generated between the pair of flow adjustment ribs, and the air in the ink can be fast discharged under the flow. Moreover, the ink or air between the spaces W11, W12 that act as the stagnation portions is also sucked through the intervals 41*da*, 41*ea*. Thus, if the mixture of the color inks exists in the spaces W11, W12, it is removed by the sucking. In this way, the smooth flow of the ink in the ink storage chamber 41 can be reserved, thereby improving the discharge property of the mixture of the color inks.

It is noted that the purging operation not only can attain the sucking from the nozzle side of the recording head 5, but also can generate the fast flow of the ink by applying the pressure from the ink tank side.

—Ink Storage chamber 42 of Magenta Ink—

The ink storage chamber 42 will be described below with reference to FIG. 7 and FIG. 11. It is noted that, since FIG. 7 is the view when the top tank 32 is viewed from below, the left direction in FIG. 7 is referred to as [Right Direction], and the right direction in FIG. 7 is referred to as [Left Direction].

The ink storage chamber 42 of the magenta ink that is constituted by flat space which is rectangular when viewed from a flat plane and whose bottom surface is opened in the same shape is formed in the bottom surface of the middle wall 34 of the top tank 32. In the ink storage chamber 42, its circumference is defined by a circumferential wall 42*a*, and as shown in FIG. 10 to FIG. 13, it is installed on the bottom side, adjacently to the ink storage chamber 41 through the middle wall 34.

An ink inlet 42*b* of the ink storage chamber 42 of the magenta ink has the shape of a round hole, and it is opened in the bottom surface near a right front corner inside the ink storage chamber 42, and it penetrates the top tank 32 and is connected to the downstream end of the ink flow path 56M (refer to FIG. 6).

An ink outlet 42*c* of the ink storage chamber 42 has the shape of a rectangular hole, and it is opened in the bottom surface near a left back corner that becomes at a position diagonal to the ink inlet 42*b*, and it penetrates the top tank 32. On the top surface of the top tank 32, the connection output path 65M is formed at a position which corresponds to the ink outlet 42*c* and is also outside the ink storage chamber 41. One end of the connection output path 65M is connected to the ink outlet 42*c* penetrating the top tank 32, and the other end is connected to the ink output path 51M through an opening 65Ma that penetrates the top tank 32, from the top side to the bottom side. Two ink supply ports 39Ma, 39Mb are installed in the bottom surface of the ink output path 51M.

The ink inlet 42*b* and ink outlet 42*c* of the magenta ink are installed at the substantially diagonal positions of the ink storage chamber 42. In other words, they are formed at the positions located substantially farthest from each other, with most of the space inside the ink storage chamber 42 between. In short, the ink inlet 42*b* and ink outlet 42*c* of the magenta ink are formed at the positions located substantially farthest from each other, respectively, while most of the space through which the ink inside the ink storage chamber 42 flows is sandwiched between them.

Also, the ink storage chamber 41 of the yellow ink and the ink storage chamber 42 of the magenta ink have the relation that they are adjacent in the upward/downward direction with the middle wall 34 of the top tank 32 between. In short, the top and bottom surfaces of the middle wall 34 serve as the other wall surfaces opposite to the films 61, 62 serving as one flexible wall surfaces. The ink inlet 41*b* and ink outlet 41*c* of the yellow ink and the ink inlet 42*b* and ink outlet 42*c* of the magenta ink are arranged at the positions different from each other, along the middle wall 34. In short, when the top tank 32 is viewed from a flat plane, a line through which the ink inlet 41*b* and ink outlet 41*c* of the yellow ink are linked and a line through which the ink inlet 42*b* and ink outlet 42*c* of the magenta ink are linked extend to the different directions and then intersect each other, such as the diagonal lines.

The surface that is opened below the ink storage chamber 42 is enclosed with the flexible film 62. The film 62 is joined onto the circumferential wall 42*a* of the ink storage chamber 42 by using the joining method such as the adhesion, the thermal welding and the like. Consequently, the ink storage chamber 42 is zoned.

Flow adjustment ribs 42*d*, 42*e* are uprightly formed on the bottom surface of the ink storage chamber 42. The flow adjustment ribs 42*d*, 42*e* are installed in parallel so that, while they sandwich the diagonal line through which the ink inlet 42*b* and ink outlet 42*c* of the magenta ink are linked, the distances from the diagonal line becomes equal. Also, in the flow adjustment ribs 42*d*, 42*e*, the respective longitudinal sections are rectangular, and both are formed at the heights equal to about half of a depth of the ink storage chamber 42 (the distance from the film 62 to the bottom surface) and separated from the film 62 so that the movement of the film 62 is not limited. The flow adjustment ribs 42*d*, 42*e* guide the fast flow of the ink from the ink inlet 42*b* to the ink outlet 42*c*.

Also, the pair of flow adjustment ribs 42*d*, 42*e* is located apart from the circumferential wall 42*a* outside the mutual opposite directions of both the flow adjustment ribs 42*d*, 42*e*, by triangular spaces W21, W22 when they are viewed from flat planes. The ends of the ink flow directions of the pair of flow adjustment ribs 42*d*, 42*e* are separated from the inner wall surface of the circumferential wall 42*a* in their extension directions, by intervals 42*da*, 42*db*, 42*ea* and 42*eb*. Thus, through the intervals 42*da*, 42*db*, 42*ea* and 42*eb*, a space W23 (a space serving as the ink flow path) between the pair of flow adjustment ribs 42*d*, 42*e* and the spaces W21, W22 from the circumferential wall 42*a* outside them are connected. It is noted that the intervals 42*da*, 42*db*, 42*ea* and 42*eb* are set at lengths of about 1 to 2 mm.

Thus, similarly to the ink storage chamber 41 of the yellow ink, at the time of the purging operation, the mixture of the color inks between the spaces W21, W22 acting as the stagnation portions is sucked through the intervals 42*da*, 42*ea*. Thus, the smooth flow of the ink in the ink storage chamber can be reserved, thereby making the discharge property of the mixture of the color inks higher.

—Ink Storage chamber 43 of Cyan Ink—

The ink storage chamber 43 will be described below with reference to FIG. 8 and FIG. 12.

On the top side of the middle wall 35 of the bottom tank 33, at the position corresponding to the ink storage chamber 42 of the magenta ink, the ink storage chamber 43 of the cyan ink having the same shape is zoned by a circumferential wall 43*a* and upwardly opened. The open surface of the ink storage chamber 43 of the cyan ink is enclosed with a film 63 that is substantially rectangular and flexible, similarly to the ink storage chamber 42 of the magenta ink. Thus, the film 62 of the ink storage chamber 42 of the magenta ink and the film 63 of the ink storage chamber 43 of the cyan ink are separated and located parallel and opposite to each other.

An ink inlet 43*b* of the cyan ink is opened in the bottom surface near a left front corner inside the ink storage chamber 43, and it penetrates the middle wall 35 of the bottom tank 33 in its thickness direction and is connected to one end of a linkage path 66 formed in the bottom surface of the middle wall 35. Outside the ink storage chamber 44 of the black ink, the linkage path 66 is formed at its left front corner, and the other end is connected to the bottom end of the ink linkage path 58C penetrating the middle wall 35 in its thickness direction.

In short, the ink flow path 56C formed in the top surface of the middle wall 34 of the top tank 32 is linked through the linkage path 66 and the ink linkage path 58C penetrating the top and bottom tanks 32, 33 in the lamination direction, to the ink inlet 43*b* of the cyan ink in the ink storage chamber 43.

Figure 9:
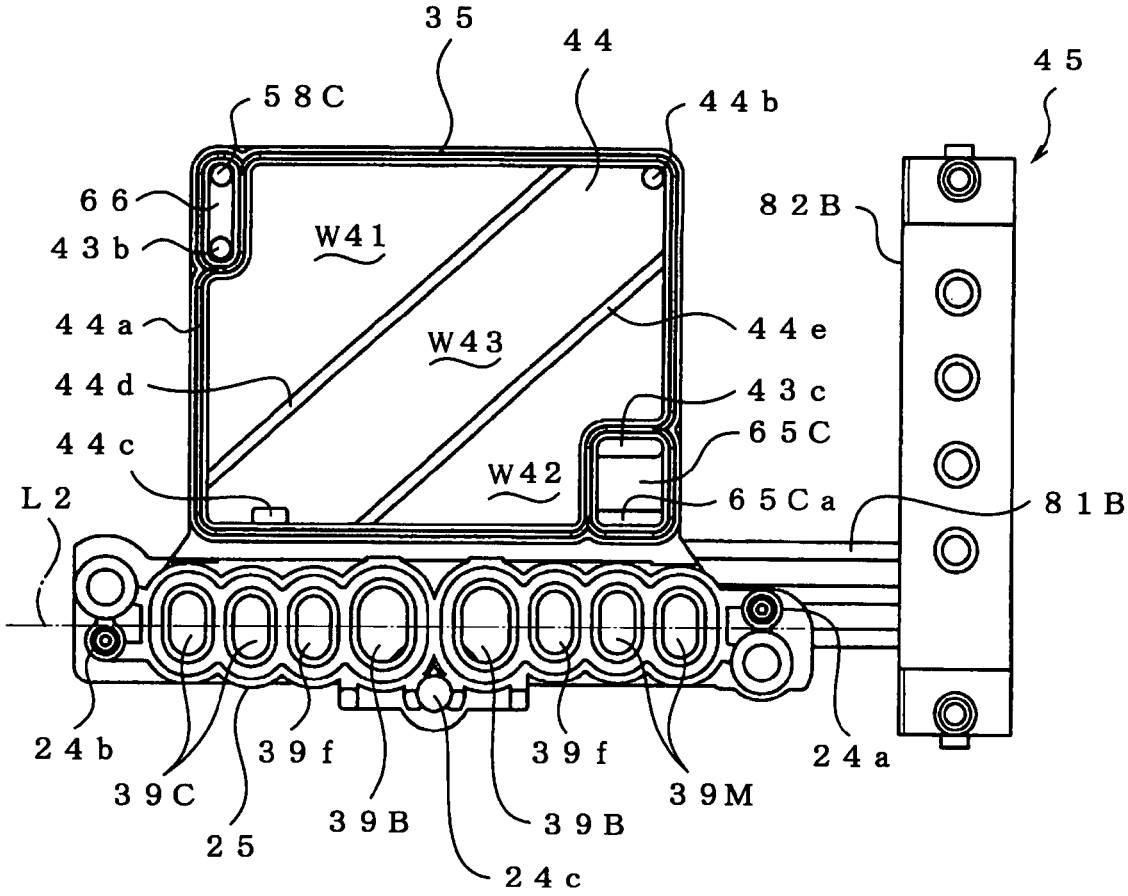
FIG. 9 is a plan view when the bottom tank is viewed from below.

An ink outlet 43*c* of the ink storage chamber 43 is opened in the bottom surface near a right back corner inside the ink storage chamber 43, and it penetrates the middle wall 35 in the bottom tank 33 in its thickness direction, and it is connected to a connection output path 65C formed in the bottom surface of the bottom tank 33. As shown in FIG. 9, outside the ink storage chamber 44 of the black ink, the connection output path 65C is formed in the cross-sectional rectangular shape at its right back corner. The downstream end portion of this connection output path 65C is located so as to overlap with the ink output path 51C when it is viewed from a flat plane, and it is connected to the position lower than the top end of the ink output path 51C through a penetration opening 65Ca to the upward direction from the downward direction in the bottom tank 33 (refer to FIG. 12).

Also, in the bottom surface of the ink storage chamber 43, namely, on the top side of the middle wall 35, flow adjustment ribs 43*d*, 43*e* having the same shapes as the flow adjustment ribs 42*d*, 42*e* (refer to FIG. 7) are installed. The pair of flow adjustment ribs 43*d*, 43*e* is located apart from the circumferential wall 43*a* outside the mutual opposite directions of both the flow adjustment ribs 43*d*, 43*e*, by triangular spaces W31, W32 when they are viewed from flat planes. The ends of the ink flow directions of the pair of flow adjustment ribs 43*d*, 43*e* are located apart from the inner wall surface of the circumferential wall 43*a* in their extension directions, by intervals 43*da*, 43*db*, 43*ea* and 43*eb*. Thus, through the intervals 43*da*, 43*db*, 43*ea* and 43*eb*, a space W33 (a space serving as the ink flow path) between the pair of flow adjustment ribs 43*d*, 43*e* and the spaces W31, W32 from the circumferential wall 43*a* outside them are connected. It is noted that the intervals 43*da*, 43*db*, 43*ea* and 43*eb* are set at the lengths of about 1 to 2 mm.

Thus, similarly to the ink storage chambers 41, 42 of the yellow and magenta inks, at the time of the purging operation, the mixture of the color inks between the spaces W31, W32 acting as the stagnation portions is sucked through the intervals 43*da*, 43*ea*. Hence, the smooth flow of the ink in the ink storage chamber can be reserved, thereby making the discharge property of the mixture of the color inks higher.

—Ink Storage chamber 44 of Black Ink—

The ink storage chamber 44 will be described below with reference to FIG. 9 and FIG. 13. It is noted that since FIG. 9 is the view when viewed from below, the upward direction in FIG. 9 is referred to as [Forward Direction], and the downward direction in FIG. 9 is referred to as [Backward Direction].

In the bottom surface of the middle wall 35 in the bottom tank 33, the ink storage chamber 44 of the black ink that is constituted by flat space which is substantially rectangular when it is viewed from a flat plane and whose bottom surface is opened in the same shape is formed. In the ink storage chamber 44, its circumference is zoned by a circumferential wall 44*a*, and as shown in FIG. 10 to FIG. 13, it is installed adjacently to the ink storage chamber 43 of the cyan ink in the upward/downward direction through the middle wall 35.

Also, the linkage path 66 of the cyan ink adjacent to the left front corner of the ink storage chamber 44 and the connection output path 65C adjacent to the right back corner are zoned and installed, respectively.

The front part of the ink storage chamber 44 is located so as to overlap with the ink linkage path 58B when it is viewed from a flat plane, and the ink linkage path 58B penetrates the bottom tank 33 in the upward/downward direction, and it is opened in the bottom surface near the right front corner inside the ink storage chamber 44. In short, the bottom end opening of the ink linkage path 58B serves as the ink inlet 44*b* of the ink storage chamber 44.

The ink outlet 44*c* of the black ink from which the black ink inside the ink storage chamber 44 flows out is opened in the bottom surface near the left back corner inside the ink storage chamber 44. This ink outlet 44*c* serves as the bottom end of a penetration path 69B that penetrates the top and bottom tanks 32, 33 in the upward/downward direction, and the top end of this penetration path 69B is opened at one end of the ink path 70B on the top surface side of the middle wall 34 in the top tank 32, and it is connected to the top portion of the ink output path 51B from the other end opening 70Ba of the ink path 70B which penetrates the top tank 32 in the upward/downward direction through this ink path 70B.

The ink inlet 44*b* and ink outlet 44*c* of the black ink are installed at the substantially diagonal positions in the ink storage chamber 44. In other words, they are formed at the positions located substantially farthest from each other, respectively, with most of the space inside the ink storage chamber 44 between.

Also, the ink storage chamber 44 and the ink storage chamber 43 have the relation that they are adjacent in the upward/downward direction through the middle wall 35 in the bottom tank 33. The ink inlet 44*b* and ink outlet 44*c* of the black ink and the ink inlet 43*b* and ink outlet 43*c* of the cyan ink are arranged at the positions different from each other, along the middle wall 35.

In short, when the bottom tank 33 is viewed from a flat plane, the line through which the ink inlet 43*b* and ink outlet 43*c* of the cyan ink are linked and the line through which the ink inlet 44*b* and ink outlet 44*c* of the black ink are linked extend in the different directions and intersect each other such as the diagonal lines.

The surfaces that are opened below the ink storage chamber 44 of the black ink, the linkage path 66 and the connection output path 65C are enclosed with a flexible film 64. The bottom surfaces of the circumferential wall 44*a* that defines the linkage path 66, the connection output path 65C and the ink storage chamber 44 are formed on the same flat surface, and the film 64 is joined onto the surfaces by using the joining method such as the adhesion, the thermal welding and the like. Thus, the ink storage chamber 44 of the black ink, the linkage path 66 and the connection output path 65C are zoned, respectively.

On the bottom surface of the ink storage chamber 44, flow adjustment ribs 44*d*, 44*e* are uprightly installed under a certain interval on both sides of the line through which the ink inlet 41*b* and the ink outlet 41*c* are linked. In the flow adjustment ribs 44*d*, 44*e*, the respective longitudinal sections are rectangular, and both are formed at the heights equal to about half of a depth of the ink storage chamber 44 (the distance from the film 64 to the bottom surface) and separated from the film 64 so that the movement of the film 64 is not limited. The flow adjustment ribs 44*d*, 44*e* guide the fast flow of the ink from the ink inlet 44*b* to the ink outlet 44*c*. Their ends are connected onto the inner wall surface of the circumferential wall 44*a*.

Also, the pair of flow adjustment ribs 44*d*, 44*e* is located apart from the circumferential wall 44*a* outside the mutual opposite directions of both the flow adjustment ribs 44*d*, 44*e*, by triangular spaces W41, W42 when they are viewed from flat planes. The ends of the ink flow directions of the pair of flow adjustment ribs 44*d*, 44*e* are connected to the inner wall surface of the circumferential wall 44*a* in their extension directions. Thus, the connection between a space W43 (a space serving as the ink flow path) between the pair of flow adjustment ribs 44*d*, 44*e* and the spaces W41, W42 from the circumferential wall 44*a* outside them are shut off, and the flow adjustment effect is made higher than the other ink storage chambers 41 to 43.

It is noted that as shown in FIG. 3 and FIG. 9, a buffer tank 31 is fixed to the recording head 5 fixed to the bottom surface of the bottom wall 4*c* of the head holder 4 with three screws 23. Specifically, penetration holes 24*a*, 24*b* and 24*c* are made outside both ends of ink supply ports 39M to 39C arranged in a line and outside a middle portion, and the screws 23 are inserted into the penetration holes 24*a* to 24*c*, respectively. Seal rubber materials (not shown) are sandwiched between the ink supply ports 39M to 39C and the ink flow inlets 21M to 21C, and the buffer tank 31 is fixed to the recording head 5 with the screws 23. Around the ink supply ports 39M to 39C, fall protection ribs 25 of the seal rubber materials are installed along the outer circumference of the seal rubber materials, and a central penetration hole 24*c* is continuously made in a part of the ribs 25, and the penetration holes 24*a*, 24*b* at both ends are made apart from each other by a distance of about 1 to 2 mm, in the direction opposite to each other, from a load center axis L2 in a horizontal direction of the seal rubber materials.

(Flow Manner of Each Ink)

The yellow ink is inputted to the ink storage chamber 41 from the ink inlet 41*b* through the ink flow paths 53Y, 56Y from the ink flow path opening 52Y, as shown in FIG. 6 and FIG. 7. The yellow ink inputted to the ink storage chamber 41 traverses and flows through most of the space inside the ink storage chamber 41, from the ink inlet 41*b* to the ink outlet 41*c*. In this case, the smooth flow of the ink associated with the ink discharge caused by the recording is reserved by the flow adjustment ribs 41*d*, 41*e*. The intervals 41*da*, 41*db*, 41*ea* and 41*eb* are about 1 to 2 mm. Thus, even if the air stays outside the flow adjustment ribs, there is no case that the air is pulled by the ink flow. Also, according to the ink flow faster than the ink flow at the time of the recording in the pursing operation, the ink outside the flow adjustment ribs can be quickly discharged.

Figure 10:
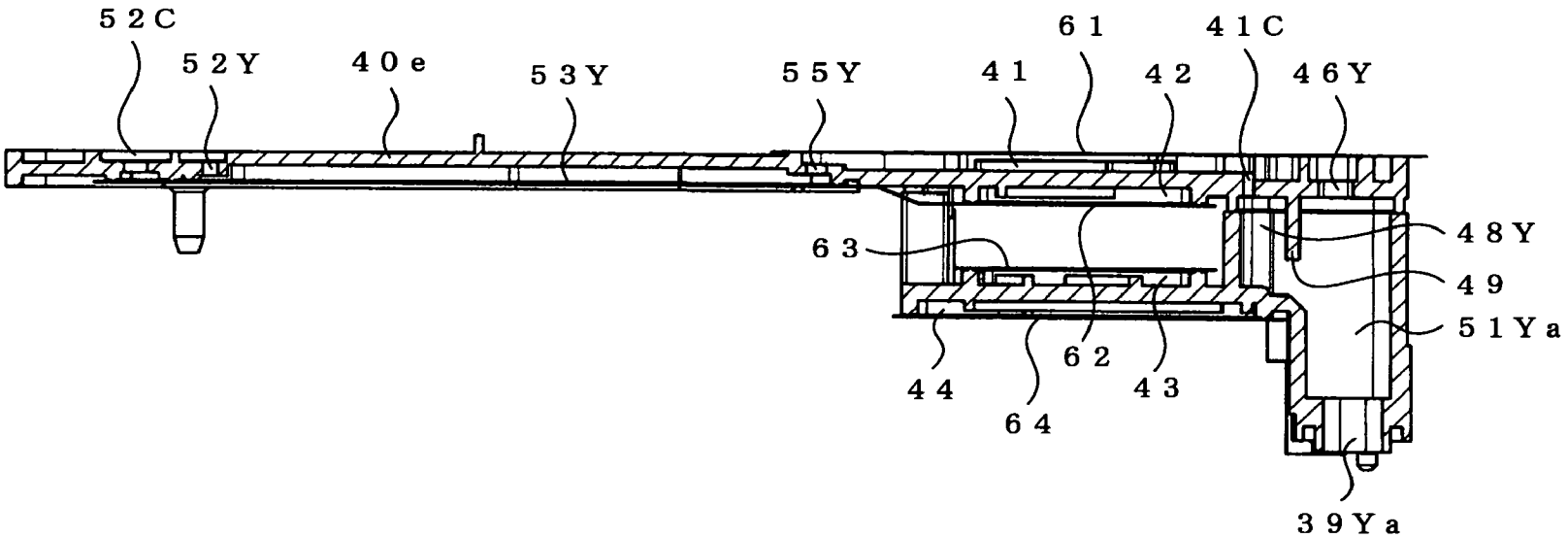
FIG. 10 is a sectional view on a Y-Y line of FIG. 5.

The yellow ink that flows out from the ink outlet 41*c* of the ink storage chamber 41 arrives at the ink output paths 51Ya, 51Yb, which are separated from each other, through the ink guide path 48Y installed so as to detour the ink output path 51B, as shown in FIG. 10, and is supplied from the ink supply ports 39Ya, 39Yb to the ink flow inlets 21Ya, 21Yb of the recording head 5.

The magenta ink is inputted to the ink storage chamber 42 below the top tank 32 from the ink inlet 42*b*, through the ink flow paths 53M, 56M from the ink flow path opening 52M, as shown in FIG. 6 and FIG. 7. The magenta ink inputted to the ink storage chamber 42 flows from the ink inlet 42*b* to the ink outlet 42*c*. In this case, the smooth flow of the ink in the ink storage chamber 42 is reserved by the flow adjustment ribs 42*d*, 42*e*.

Figure 11:
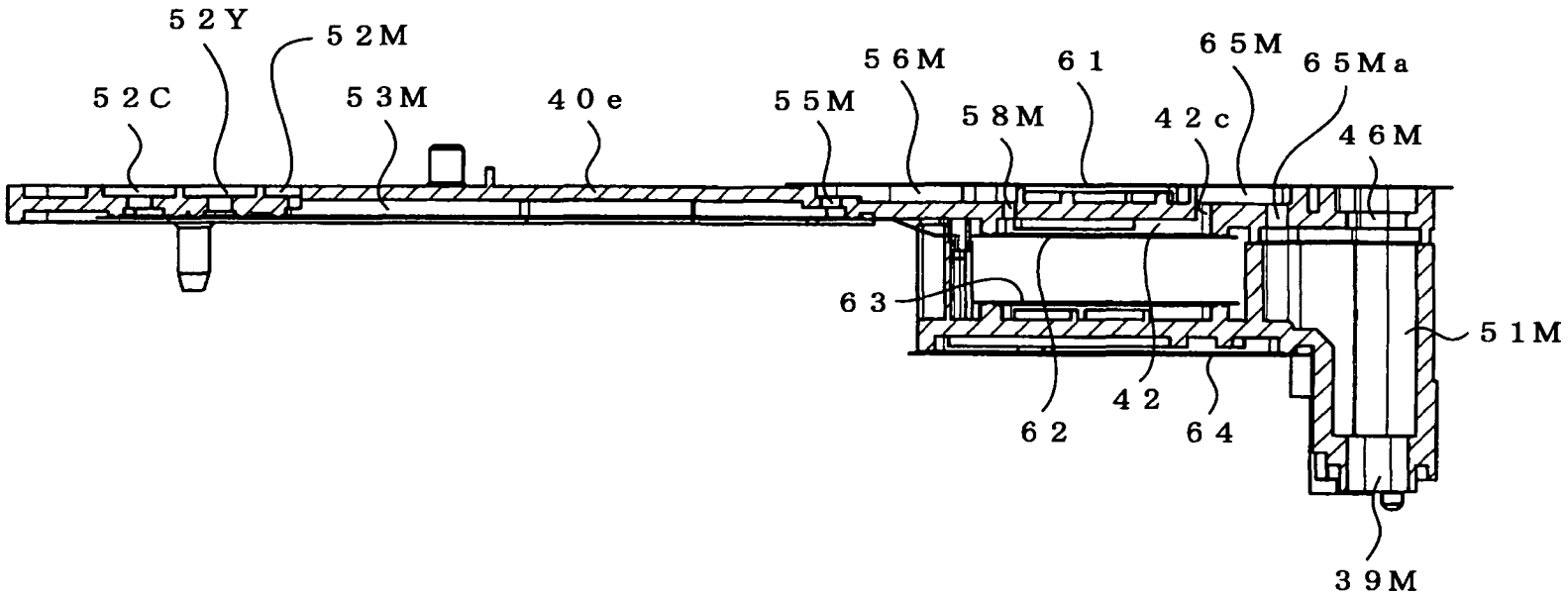
FIG. 11 is a sectional view on an M-M line of FIG. 5.

The magenta ink that flows out from the ink outlet 42*c* in the ink storage chamber 42 arrives at the ink output path 51M through the connection output path 65M and the ink guide path 48Y, as shown in FIG. 11, and is supplied to the ink flow inlets 21Ma, 21Mb of the recording head 5 from the ink supply ports 39Ma, 39Mb.

As shown in FIG. 6, FIG. 7 and FIG. 8, the cyan ink flows into the linkage path 66 on the bottom surface side of the bottom tank 33, through the ink linkage path 58C penetrating the top and bottom tanks 32, 33 in the lamination direction, through the ink flow paths 53C, 56C from the ink flow path opening 52C, and is then inputted to the ink storage chamber 43 on the top surface side from the ink inlet 43*b*. The cyan ink inputted to the ink storage chamber 43 flows from the ink inlet 43*b* to the ink outlet 43*c*. In this case, the smooth flow of the ink in the ink storage chamber 42 is reserved by the flow adjustment ribs 43*d*, 43*e*.

Figure 12:
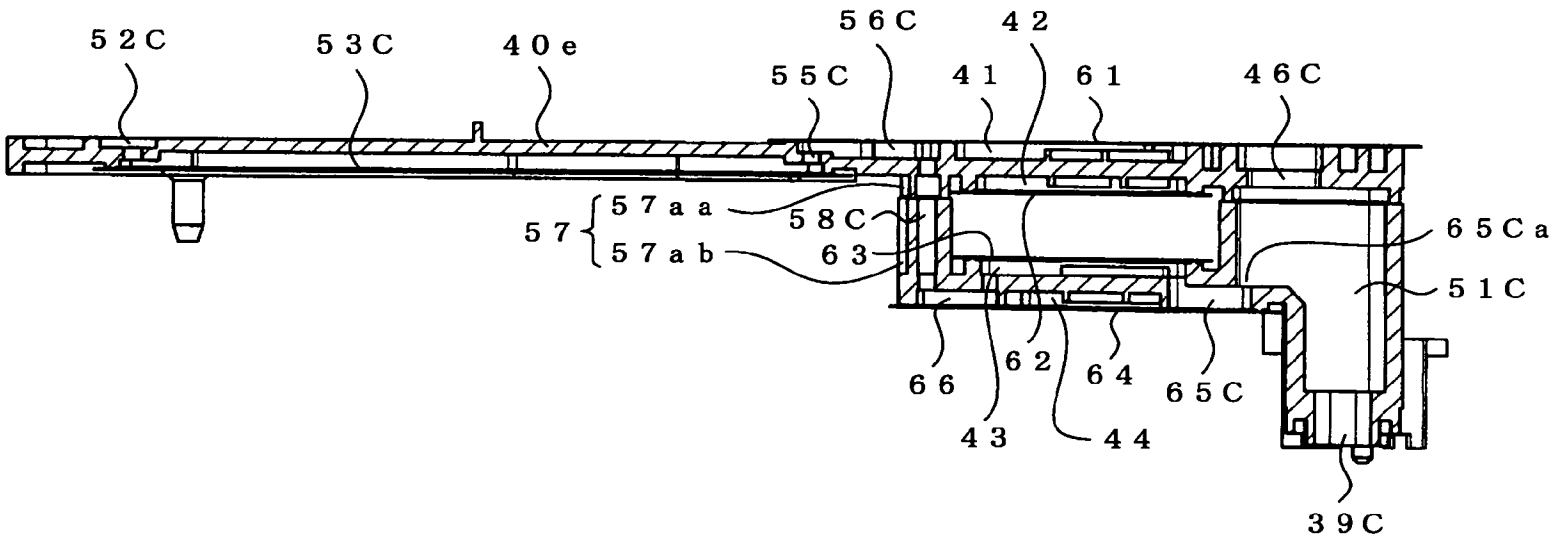
FIG. 12 is a sectional view on a C-C line of FIG. 5.

The ink that flows out from the ink outlet 43*c* of the ink storage chamber 43 arrives at the ink output path 51C through the connection output path 65C, as shown in FIG. 12, and is supplied to the ink flow inlets 21Ca, 21Cb of the recording head 5 from the ink supply ports 39C, 39Cb.

The black ink is inputted from the ink inlet 44*b* (the bottom end opening of the ink linkage path 58B) to the ink storage chamber 44 in the bottom surface side of the bottom tank 33, through the ink linkage path 58B penetrating the top and bottom tanks 32, 33 in the lamination direction, through the ink flow paths 53B, 56B from the ink flow path opening 52B, as shown in FIG. 6, FIG. 7 and FIG. 11. The black ink inputted to the ink storage chamber 44 flows from the ink inlet 44*b* to the ink outlet 44*c*. In this case, the smooth flow of the ink in the ink storage chamber 42 is reserved by the flow adjustment ribs 44*d*, 44*e*.

Figure 13:
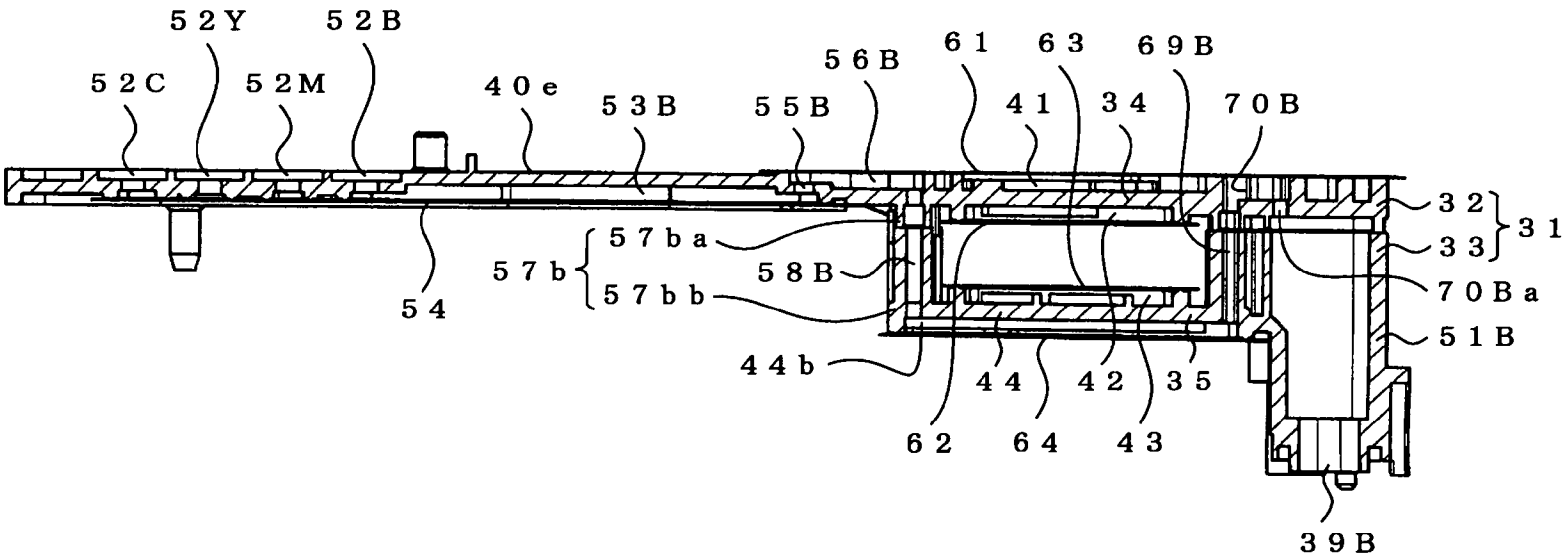
FIG. 13 is a sectional view on a B-B line of FIG. 5.

The black ink, which flows out from the ink storage chamber 44, is once raised up to the top surface side of the middle wall 34 in the top tank 32 through the penetration path 69B, as shown in FIG. 13, and arrives at the ink output path 51B through the ink path 70B, and is then supplied to the ink flow inlets 21Ba, 21Bb of the recording head 5 from the ink supply ports 39Ba, 39Bb.

In this way, the respective inks, which flow out from the ink storage chambers 41 to 44, flow into and stay in the ink output paths 51M to 51C extending in the upward/downward direction. Thus, the airs are excellently separated from the inks in the respective ink output paths 51M to 51C, and the airs caught by filters installed in the respective ink flow inlets 21M to 21C of the recording head 5 are floated, and the airs are accumulated in the upper spaces of the ink output paths 51M to 51C and can be discharged through the air discharge ports 46M to 46B to the discharge paths 71M to 71B.

The supplies of the respective inks to the respective ink flow inlets 21M to 21C of the recording head 5 as mentioned above are executed while the ink storage chambers 41 to 44 and the recording head 5 are scanned for a recording medium, and the influence of the variation in the ink pressure and the like is apt to be received. However, ones of the top and bottom wall surfaces of the ink storage chambers 41 to 44 are constituted by the flexible films 61 to 64. Thus, the variation in the ink pressure and the like can be effectively suppressed by the variation in the films 61 to 64 so that the recording can be executed at a high quality. In particular, the films 61 to 64 are contained as the wall surfaces parallel to each other to define the ink storage chambers 41 to 44. Hence, while the height of the lamination direction is suppressed, the areas of the films can be made large, which is advantage in suppressing the variation in the ink pressure and the like.

(Structure of Discharge Paths 71M to 71B)

Figure 14:
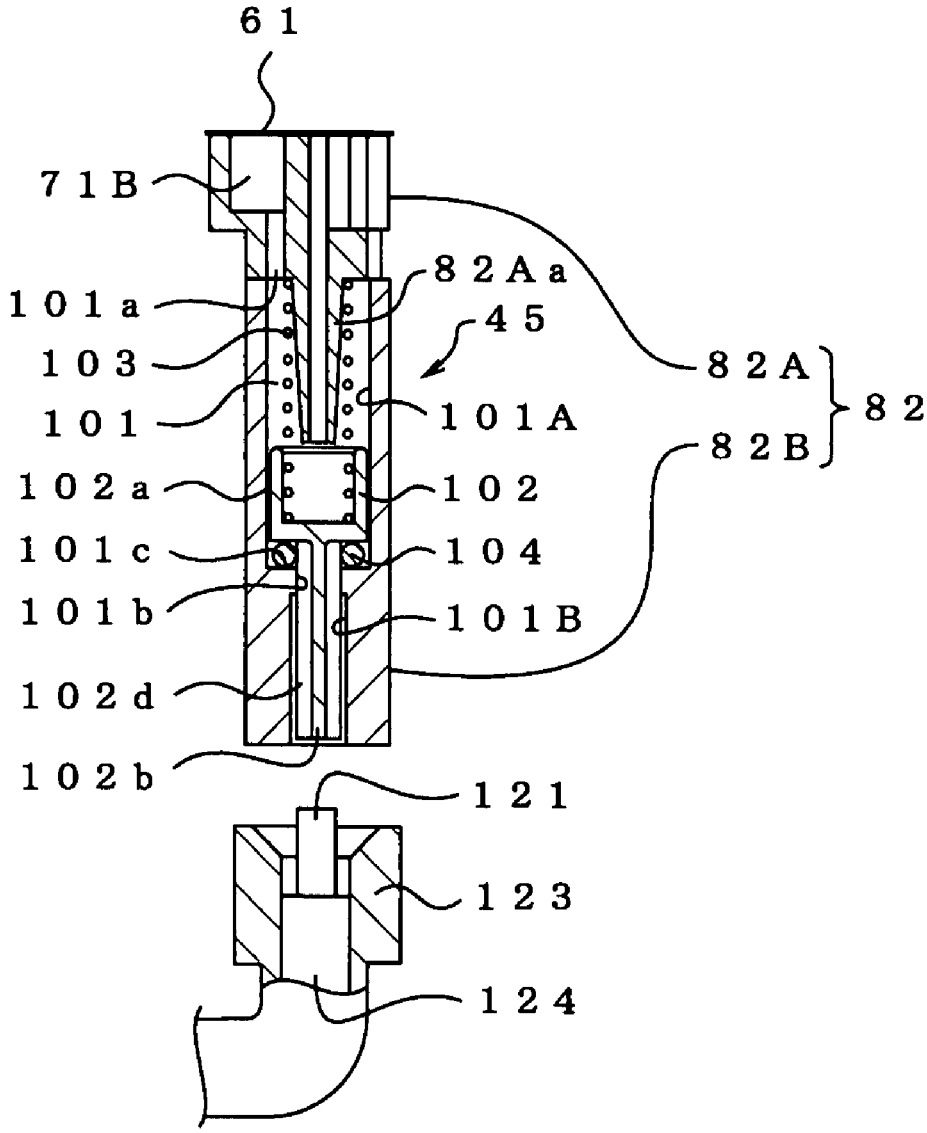
FIG. 14 is a sectional view on an XIV-XIV line of FIG. 5.

The top ends of the ink output paths 51M to 51C located above the ink supply ports 39M to 39C are connected to the air discharge ports 46M to 46C formed in the top surface of the top tank 32, as shown in FIG. 7 and FIG. 8, and connected to the top ends of respective discharging apparatuses (only a discharging apparatus 45 of the black ink is illustrated, and refer to FIG. 14) of the respective color inks, which are arranged at one side of the buffer area S2, through the discharge paths 71M, 71Y, 71B and 71C formed as the concave grooves, along the top surface of the top tank 32, respectively. The respective discharging apparatuses are arranged such that the axis line directions of respective discharging valves become parallel to the longitudinal directions of the ink output paths 51M to 51C. In this way, the air discharge ports 46M to 46C located at the top ends of the ink output paths 51M to 51C and the top ends of the discharging apparatuses are connected to each other through the discharge paths 71M to 71C formed in the top surface of the top tank 32. It is noted that the respective discharge paths 71M to 71C are defined such that their open top surfaces are covered by extending the flexible film 61 serving as the top surface of the ink storage chamber 41.

The respective discharge paths 71M to 71C are once bent to the right direction from the top ends of the ink output paths 51M to 51C, along the side edge of the ink storage chamber 41 of the yellow ink, on the top surface of the top tank 32, as shown in FIG. 6, and forwardly extended and connected to the top ends of the respective discharging apparatuses.

Since the discharging apparatus is drive-controlled to suitably perform the opening operation on the discharging valve, the airs accumulated in the upper spaces of the respective ink output paths 51M to 51C are discharged through the discharge paths 71M to 71C to the outside.

(Schematic Structure of Discharging Apparatus and Maintenance Unit)

A plurality of discharging apparatuses are installed correspondingly to the number of the ink output paths 51M to 51C. They are arranged in a line in substantial parallel to the row generated by the cylindrical walls 40*a*, 40*b*, the ink storage chambers 41 to 44 and the cylindrical walls 57*a*, 57*b*, to the ink input area S1 through the buffer area S2 from the ink output area S3.

The discharging apparatuses are extensively installed through arms 81 (81A, 81B) from the top and bottom tanks 32, 33, respectively, and arranged at the right side different from the back side where the ink output paths 51M to 51C of the ink storage chambers 41 to 44 are installed in the shape of a row.

A lower portion 82B of a discharging valve box 82 in the discharging apparatus contains a cylindrical wall 45*b* in the extension state to the upward/downward direction and, it is coupled to the bottom tank 33 through a lower portion 81B of the arm 81.

On the other hand, an upper portion 82A of the discharging valve box 82 contains a cylindrical wall 45*a* overlapping with the top end of the cylindrical wall 45*a* in the top tank 32, and is coupled to the top tank through an upper portion 81A of the arm 81. The middle portions of the discharge paths 71M to 71B are installed on the top surface side of the upper portion 81A of this arm 81. The downstream ends of the discharge paths 71M to 71B are extended onto the cylindrical wall 45*a* and linked to the inner space of the cylindrical wall 45*b* through the inner space of the cylindrical wall 45*a*.

In short, the top tank 32 integrally contains the upper portion 82A of the discharging valve box 82 including the cylindrical wall 45*a*, and the bottom tank 33 integrally contains the lower portion 82B of the discharging valve box 82 including the cylindrical wall 45*b*. Then, when the top and bottom tanks 32, 33 are joined as mentioned above, the cylindrical walls 45*a*, 45*b* are also joined at the same time, and the discharging valve box 82 is formed.

Also, in the lower portion 82B of the discharging valve box 82, fasteners 33*b* are formed at both ends in the array direction of a discharging apparatus 45, and on the other hand, fastened holes 32*b* to be fasten so as to be able to be fastened to and de-fastened from the fasters 33*b* are formed in the upper portion 82A. In the situation that they are fastened, the cylindrical walls 45*a*, 45*b* are joined to each other. If they are done in this way, the axis lines of coil springs of the respective discharging apparatuses (for example, a coil spring 103 of the discharging apparatus of the black ink, refer to FIG. 14) are arranged on a line L1 (refer to FIG. 6) through which the fastened portions between the fasters 33*b* and the fastened holes 32*b* are linked. Thus, when the upper and lower portions 82A, 82B are fastened, there is no case that the upper portion 82A is inclined by the spring force of the coil spring. Hence, when the joining such as the supersonic welding and the like is executed, it is possible to avoid the joining displacement from being generated between the upper portion 82A and the lower portion 82B.

Although the discharging apparatus is installed for each of the discharge paths 71M to 71B, all of them are equal in configuration. Thus, the discharging apparatus of the black ink will be described below with reference to FIG. 14.

A discharge hole 101 linked to the discharge path 71B is long in upward/downward direction and opened in the upward/downward direction, as shown in FIG. 14, and it has a discharge inlet 101*a* and a discharge outlet 101*b* and functions as a valve room where a discharging valve 102 can be slid. The discharge hole 101 has a large diameter hole 101A located on the top side and a small diameter hole 101B located on the bottom side, and they are linked through the discharge outlet 101*b*.

The discharging valve 102 contains: a valve 102*a* of a large diameter; a valve rod 102*b* of a small diameter that is integrally linked to the bottom end thereof, and a ring-shaped seal material 104 engaged in this valve rod 102*b*. The valve 102*a* is larger in diameter than the valve rod 102*b*, and installed in the valve rod 102*b* so that the seal material 104 is brought into contact with the valve 102*a*. Also, the valve 102*a* is opposite to an open end plane 101C (valve sheet plane) around the discharge outlet 101*b*, which serves as the bottom surface of the large diameter hole 101A and the top end opening of the small diameter hole 101B, through the seal material 104. Then, the valve 102*a* of the large diameter is inserted into the large diameter hole 101A of the valve hole 101, and the valve rod 102*b* is inserted into the small diameter hole 101B, while gaps that enable the respective air (gas) distributions are left. Thus, the discharging valve 102 is supported such that it can be slid inside the discharge hole 101 (valve room) in its central axis line direction. The valve rod 102*b* is pushed up by a protrusion shaft 121 installed in the maintenance unit, when the valve is opened which will be described later. Hence, the bottom end thereof (in the situation that the valve is closed) is located near the bottom end opening of the small diameter hole 101B.

The open end plane 101C around the discharge outlet 101*b* linked to atmosphere serves as the valve sheet plane, and the seal material 104 is placed between this open end plane 101C and the valve 102*a*.

Also, a coil spring 103 is inserted into the large diameter hole 101A, as a pushing device for pushing the discharging valve 102 (valve 102*a*) in a direction where the discharge outlet 101*b* is closed. In short, the top end of the coil spring 103 is engaged in the outside of a fastening convex 82Aa of the upper portion 82A of the discharging valve box 82, and the bottom end is engaged and inserted into an upper concave of the valve 102*a*. The discharge inlet 101*a* is formed around the fastening convex 82Aa, and the flow path for the discharging (air) to the discharge outlet 101*b* from the discharge inlet 101*a* is formed outside the coil spring 103.

In this way, the valve 102*a* is always pushed against the direction where the seal material 104 is brought into contact with the open end plane 101C, by the coil spring 103. Thus, at the usual time when the pushing force of the protrusion shaft 121 does not act on the discharging valve 102, the valve 102*a* of the discharging valve 102 becomes in the valve close state where the discharge outlet 101*b* is closed.

A plurality of grooves 102*d* are formed along the entire length of the valve rod 102*b* of the discharging valve 102. The grooves 102*d* formed in this valve rod 102*b* function as the gap (the discharge flow path) that surely allows the air flow between the valve rod 102*b* and the seal material 104, when the valve 102*a* and the seal material 104 are separated.

Also, as the maintenance unit for carrying out the cleaning of the nozzle surface of the recording head 5, the recovering process to selectively suck the ink for each color and the removing process to remove the air staying inside the buffer tank 31, this contains: a first cap member 122 (refer to FIG. 3) for covering the open surfaces of the nozzles 35 to 38 of the recording head 5 so that they can be opened/closed; and a plurality of second cap members 123 for individually covering the bottom end surfaces (namely, the bottom end open surfaces of the respective small diameter holes 101*b*) of the discharging valve box 82 so that they can be opened/closed. The cap members 122, 123 are supported by the top/bottom movement mechanism similar to a known maintenance unit so that they can be moved in the upward/downward direction. When the recording head 5 is moved to a wait position where the recording is not executed, the cap members 122, 123 are moved to the raised positions that are in contact with the nozzle open surfaces and the bottom end surface of the discharging valve box 82, and at different positions, they are moved to the lowered positions so that they are separated from their surfaces. Also, the first cap member 122 is connected to a sucking pump (not shown) similarly to the known maintenance unit, and the increased stuck inks and foreign materials are configured to be sucked and removed from the nozzles 35 to 38 by the driving of this sucking pump.

Each of the second cap members 123 has the protrusion shaft 121 protruding from the cap member 123. Then, when it is brought into contact with the bottom end surface of the discharging valve box 82, the discharging valve 102 is pushed up against the pushing force of the coil spring 103 by the protrusion shaft 121, and the seal material 104 is separated from the open end surface 101C of the large diameter hole 101A, and it is set at the valve open state where the discharge outlet 101*b* is opened.

Each of the second cap members 123 is connected through a discharge flow path 124 to the sucking pump, and the airs accumulated inside the upper spaces of the respective ink output paths 51M to 51C are collectively sucked by the driving of the sucking pump and discharged to the atmosphere. In this way, the airs accumulated in the upper spaces of the respective ink output paths 51M to 51C can be discharged to the outside.

It is noted that the first cap member 122 and the second cap members 123 are alternatively connected to the sucking pump by a switching valve (not shown).

In the above-mentioned embodiment, as for the black ink, the problem of the mixture with the other colors is not easily generated. Thus, in order to make the flow adjustment effect high, the ends of the flow adjustment ribs 44*d*, 44*e* to be installed in the ink storage chamber 44 are connected to the inner surface of the circumferential wall 44*a*. However, the intervals may be installed between the ends of the flow adjustment ribs 44*d*, 44*e* and the inner wall surface of the circumferential wall 44*a*, similarly to the ink storage chambers 41 to 43 of the other colors.

In the inkjet printer, the ink storage chamber is substantially rectangular when viewed from the flat plane, and the ink inlet and the ink outlet are arranged under the relation that they are located on the substantial diagonal line of the ink storage chamber.

The ink inlet and the ink outlet are formed at the positions located substantially farthest from each other, with most of the space inside the ink storage chamber between, and one of the flexible wall surfaces can be effectively used to absorb the pressure variation in the ink.

The use of the guide ribs makes the flow adjustment effect near the ink outlet higher.

The interval between the end in the flow direction of the pair of flow adjustment ribs and the circumferential wall is the length of about 1 to 2 mm. Thus, the ink flow associated with the ink discharge for the usual recording is never damaged, and even if the air stays outside the flow adjustment ribs, the air is never pulled into the flow. Also, even if the mixture of the color inks is in the stagnation state outside the pair of flow adjustment ribs, it can be quickly discharged by the fast flow of the ink through the purging operation and the like.

The flexible film is joined to the circumferential wall so that its movement is not limited. Thus, in the ink storage chamber, the pressure variation in the ink is absorbed by the flexible film.

Both of the wall surfaces of one middle wall can be used to adjacently form the two ink storage chambers, and the two ink storage chambers can be arranged in the small space.

While the height of the lamination direction of the ink storage chambers is suppressed, the area of one of the flexible wall surfaces can be made large, which is advantage in suppressing the variation in the ink pressure and the like.

In the case of the particular ink where the influence caused by the mixture of the color inks is little, the installation of the interval is not required, which enables the end of the flow adjustment rib to be connected to the inner wall surface of the circumferential wall and makes the flow adjustment effect through the pair of flow adjustment ribs high.

As mentioned above, for one of the flexible wall surfaces of the ink storage chamber, while the area enough to absorb the pressure variation in the ink is reserved, the ink flow associated with the ink discharge for the usual recording can be stably generated between the pair of flow adjustment ribs, and even if the air stays outside the pair of flow adjustment ribs, under the ink flow, the air can be suppressed from being pulled to the ink outlet. Also, even in the ink flow faster than the usual recording through the purging operation and the like, the flow can be stably generated between the pair of flow adjustment ribs, and the air in the ink can be quickly discharged under the flow. Moreover, the end in the flow direction of the flow adjustment rib is separated from the inner wall surface of the circumferential wall in its extension direction, and the space between the pair of flow adjustment ribs and the space from the circumferential wall outside them are connected through the interval. Thus, even if between the pair of flow adjustment ribs and the circumferential wall outside them, the mixture of the color inks flows and the stagnation state is consequently generated, the mixture of the color inks can be quickly removed by the fast ink flow through the purging operation and the like.

As this description may be embodied in several forms without departing from the spirit of essential characteristics thereof, the present embodiments are therefore illustrative and not restrictive, since the scope is defined by the appended claims rather than by description preceding them, and all changes that fall within metes and bounds of the claims, or equivalence of such metes and bounds thereof are therefore intended to be embraced by the claims.

What is claimed is:

1. An inkjet printer comprising:

a recording head having a plurality of nozzles to discharge an ink; and a storage chamber for transiently storing said ink which is supplied to said plurality of nozzles from an ink source, wherein said storage chamber includes:

an inlet to which said ink flows from said ink source and an outlet from which said ink flows out to said nozzles;

two walls opposite to each other and substantially parallel to a flow direction of said ink flowing to said outlet from said inlet;

an annular rim formed along edges of the two walls; and a pair of ribs for adjusting an ink flow, which are provided in one wall of said two walls, protrude from the one wall towards the other wall, and extend substantially parallel to said flow direction apart from the other wall, wherein said other wall has a flexibility with respect to a pressure variation generated in said ink, and said pair of ribs are spaced from said rim inside said rim.

2. The inkjet printer according to claim 1, wherein in a sectional viewing of said storage chamber through a flat surface parallel to said two walls, said storage chamber is approximately rectangular, and said inlet and outlet are substantially diagonal to each other.

3. The inkjet printer according to claim 1, wherein a ridge for orienting said ink flow to said outlet is provided in the vicinity of said outlet, being between said pair of ribs.

4. The inkjet printer according to claim 1, wherein distances between respective ends of each rib in said flow direction and said rim are approximately 1 to 2 mm in length.

5. The inkjet printer according to claim 1, wherein said rim is integrally formed along an edge of said one wall, each rib is integrally formed in said one wall, said other wall is joined to said rim, and said other wall is made of flexible film.

6. The inkjet printer according to claim 1, wherein said one wall has substantially a plate shape and is substantially horizontally disposed.

7. The inkjet printer according to claim 6, wherein an output path extending from said storage chamber in a direction orthogonal to a flat surface of said one wall links said outlet to said plurality of nozzles.

8. The inkjet printer according to claim 7, wherein said output path is substantially cylindrical, said outlet locates at one end thereof, and a protrusion extending from vicinity of said outlet towards said plurality of nozzles inside the output path for preventing air in the ink to move to said plurality of nozzles is provided.

9. The inkjet printer according to claim 1, further comprising a nozzle surface, provided on said head, in which said plurality of nozzles are arranged, wherein said one wall has substantially a plate shape and is substantially parallel to said nozzle surface.

10. The inkjet printer according to claim 9, wherein an output path extending from said storage chamber in a direction orthogonal to a flat surface of said one wall links said outlet to said plurality of nozzles through.

11. The inkjet printer according to claim 10, wherein said output path is substantially cylindrical, said outlet locates at one end thereof, and a protrusion extending from vicinity of said outlet towards said plurality of nozzles inside the output path for preventing air in the ink to move to said plurality of nozzles is provided.

12. The inkjet printer according to claim 1, wherein a plurality of ink sources are provided, and a plurality of storage chambers are provided so that inks to be supplied to said plurality of nozzles from said plurality of ink sources are transiently stored in said plurality of storage chambers respectively for each color.

13. The inkjet printer according to claim 12, wherein two storage chambers among said plurality of storage chambers are adjacent to each other and share at least a part of said one wall.

14. The inkjet printer according to claim 12, wherein said plurality of storage chambers are arranged parallel to said pair of walls and also arranged parallel to said recording head, and said respective outlets are connected to said recording head through the plurality of output paths extending in a direction orthogonal to them.

15. The inkjet printer according to claim 12, wherein said pair of ribs are spaced from said rim inside said rim in each of said plurality of storage chambers except the storage chamber that corresponds to a color of ink.

16. An inkjet printer comprising:

a recording head having a plurality of nozzles to discharge an ink and a storage chamber for transiently storing said ink which is supplied to said plurality of nozzles from an ink source, wherein said storage chamber includes:

an inlet to which said ink flows from said ink source and an outlet from which said ink flows out to said nozzles two walls opposite to each other and substantially parallel to a flow direction of said ink flowing to said outlet from said inlet;

a rim surrounding a gap between the two walls; and a pair of ribs for adjusting the ink flow which are installed so as to protrude from one wall of said pair of walls towards the other wall and extend substantially parallel to said flow direction apart from the other wall, wherein said other wall has a flexibility with respect to a pressure variation generated in said ink, the respective ribs are disposed between the other rib and said rim, a gap is provided between each of ends in said flow direction of said pair of ribs and an inner circumference of said rim, and a space between said pair of ribs linking through the gap to a space between the respective ribs and said rim.

* * * * *